US007961890B2

(12) United States Patent
Hölzer et al.

(10) Patent No.: US 7,961,890 B2
(45) Date of Patent: Jun. 14, 2011

(54) MULTI-CHANNEL HIERARCHICAL AUDIO CODING WITH COMPACT SIDE INFORMATION

(75) Inventors: Andreas Hölzer, Erlangen (DE); Jürgen Herre, Buckenhof (DE); Heiko Purnhagen, Sundbyberg (SE); Kristofer Kjörling, Solna (SE); Jonas Röden, Solna (SE); Lars Villemoes, Järfälla (SE); Jonas Engdegard, Stockholm (SE); Jeroen Breebaart, Eindhoven (NL); Erik Schuijers, Eindhoven (NL); Werner Oomen, Eindhoven (NL)

(73) Assignees: Fraunhofer-Gesellschaft zur Foerderung der Angewandten Forschung, e.V., Munich (DE); Coding Technologies AB, Stockholm (SE); Koninklijke Philips Electronics N.V., BA Eindhoven (NL)

( * ) Notice: Subject to any disclaimer, the term of this patent is extended or adjusted under 35 U.S.C. 154(b) by 1531 days.

(21) Appl. No.: 11/314,711

(22) Filed: Dec. 21, 2005

(65) Prior Publication Data

US 2006/0233380 A1 Oct. 19, 2006

Related U.S. Application Data

(60) Provisional application No. 60/671,544, filed on Apr. 15, 2005.

(51) Int. Cl.
*H04R 5/00* (2006.01)

(52) U.S. Cl. ..... 381/23; 381/22; 381/2; 381/3; 381/6; 381/14; 381/15; 381/16; 381/17

(58) Field of Classification Search ..... 381/22, 381/23, 2, 3, 6, 14–17

See application file for complete search history.

(56) References Cited

U.S. PATENT DOCUMENTS 5,579,430 A 11/1996 Grill et al.
5,657,350 A 8/1997 Hofmann
5,890,125 A 3/1999 Davis et al.

(Continued)

FOREIGN PATENT DOCUMENTS

EP 1107232 A3 10/2002

(Continued)

OTHER PUBLICATIONS

English translation of the Decision on Grant received on Apr. 3, 2009.

(Continued)

*Primary Examiner* — Vivian Chin
*Assistant Examiner* — Paul Kim
(74) *Attorney, Agent, or Firm* — Laurence A. Greenberg; Werner H. Stemer; Ralph E. Locher

(57) ABSTRACT

A parametric representation of a multi-channel audio signal describes the spatial properties of the audio signal well with compact side information when a coherence information, describing the coherence between a first and a second channel, is derived within a hierarchical encoding process only for channel pairs including a first channel having only information of a left side with respect to a listening position and including a second channel having only information from a right side with respect to a listening position. As within the hierarchical process the multiple audio channels of the audio signal are downmixed iteratively into monophonic channels, one can pick the relevant parameters from an encoding step involving only channel pairs carrying the information needed to describe the spatial properties of the multi-channel audio signal.

33 Claims, 15 Drawing Sheets

U.S. PATENT DOCUMENTS

| | | | | |
|---|---|---|---|---|
| 6,134,200 | A | 10/2000 | Timmermans | |
| 2003/0219130 | A1* | 11/2003 | Baumgarte et al. | 381/17 |
| 2005/0074127 | A1* | 4/2005 | Herre et al. | 381/20 |
| 2005/0177360 | A1 | 8/2005 | Schuijers et al. | |

FOREIGN PATENT DOCUMENTS

| | | | |
|---|---|---|---|
| RU | 2073913 | C1 | 2/1997 |
| RU | 2123728 | C1 | 12/1998 |
| RU | 2141166 | C1 | 11/1999 |
| WO | 9904498 | A2 | 1/1999 |
| WO | 2004008806 | A1 | 1/2004 |
| WO | WO2005/101370 | A1 | 10/2005 |

OTHER PUBLICATIONS

Jeroen Breebaart, et al. High-Quality Parametric Spatial Audio Coding at Low Bit Rates—116 Convention, Berlin, Germany on May 8-11, 2004.

Christof Faller, et al. Binaural Cue Coding Applied to Stereo and Multi-Channel Audio Compression, 112 Convention in Munich, Germany on May 10-13, 2002.

Frank Baumgarte, et al. Estimation of Auditory Spatial Cues for Binaural Cue Coding,—Media Signal Processing Research, Agere Systems, Murray Hill, NJ. USA.

Christof Faller, et al., Efficient representation of Spartal Ausio using Perceptual Parametrization,—Media Signal Processing Research, Agere Systems, Murray Hill, NJ, USA dated Oct. 21-24, 2001.

Christof Faller, et al. Binaural Cue Coding: A Novel and Efficient Presentation of Spartal Audio.

Christof Faller, et al.; Binaural Cue Coding: Part II: Schemes and Applications, dated Nov. 2003.

Vhristof Faller et al.; Binural Cue Coding Applied to Audio Compression with Flexible Rendering, presented at 113 Convention, Los Angeles, CA USA, Oct. 5-8, 2002.

Jeroen Breebaart, et al: Parametric Coding of Stereo Audio, Revised Jul. 22, 2004, published in EURASIP Journa.

* cited by examiner

MULTI-CHANNEL HIERARCHICAL AUDIO CODING WITH COMPACT SIDE INFORMATION

CROSS-REFERENCE TO RELATED APPLICATION

This application claims the benefit under 35 USC §119(e) of U.S. Provisional Application No. 60/671,544, filed Apr. 15, 2005.

FIELD OF THE INVENTION

The present invention relates to multi-channel audio processing and, in particular, to the generation and the use of compact parametric side information to describe the spatial properties of a multi-channel audio signal.

BACKGROUND OF THE INVENTION AND PRIOR ART

In recent times, the multi-channel audio reproduction technique is becoming more and more important. This may be due to the fact that audio compression/encoding techniques such as the well-known mp3 technique have made it possible to distribute audio records via the Internet or other transmission channels having a limited bandwidth. The mp3 coding technique has become so famous because of the fact that it allows distribution of all the records in a stereo format, i.e., a digital representation of the audio record including a first or left stereo channel and a second or right stereo channel.

Nevertheless, there are basic shortcomings of conventional two-channel sound systems. Therefore, the surround technique has been developed. A recommended multi-channel-surround presentation format includes, in addition to two stereo channels L and R, an additional center channel C and two surround channels Ls, Rs. This reference sound format is also referred to as three/two-stereo, which means three front channels and two surround channels. In a playback environment, at least five speakers at five appropriate locations are needed to get an optimum sweet spot in a certain distance of the five well-placed loudspeakers.

Recent approaches for the parametric coding of multi-channel audio signals (parametric stereo (PS), "spatial audio coding", "binaural cue coding" (BCC) etc.) represent a multi-channel audio signal by means of a downmix signal (could be monophonic or comprise several channels) and parametric side information ("spatial cues"), characterizing its perceived spatial sound stage. The different approaches and techniques shall be reviewed shortly in the following paragraphs.

A related technique, also known as parametric stereo, is described in J. Breebaart, S. van de Par, A. Kohlrausch, E. Schuijers, "High-Quality Parametric Spatial Audio Coding at Low Bitrates", AES 116th Convention, Berlin, Preprint 6072, May 2004, and E. Schuijers, J. Breebaart, H. Purnhagen, J. Engdegard, "Low Complexity Parametric Stereo Coding", AES 116th Convention, Berlin, Preprint 6073, May 2004.

Several techniques are known in the art for reducing the amount of data required for transmission of a multi-channel audio signal. To this end, reference is made to FIG. 11, which shows a joint stereo device 60. This device can be a device implementing e.g. intensity stereo (IS) or binaural cue coding (BCC). Such a device generally receives—as an input—at least two channels (CH1, CH2, . . . CHn), and outputs a single carrier channel and parametric data. The parametric data are defined such that, in a decoder, an approximation of an original channel (CH1, CH2, . . . CHn) can be calculated.

Normally, the carrier channel will include subband samples, spectral coefficients, time domain samples etc., which provide a comparatively fine representation of the underlying signal, while the parametric data does not include such samples of spectral coefficients but include control parameters for controlling a certain reconstruction algorithm such as weighting by multiplication, time shifting, frequency shifting, phase shifting, etc. The parametric data, therefore, includes only a comparatively coarse representation of the signal or the associated channel. Stated in numbers, the amount of data required by a carrier channel can be in the range of 60-70 kbit/s in an MPEG coding scheme, while the amount of data required by parametric side information for one channel may be in the range of about 10 kbit/s for a 5.1 channel signal. An example for parametric data are the well-known scale factors, intensity stereo information or binaural cue parameters as will be described below.

The BCC Technique is for example described in the AES convention paper 5574, "Binaural Cue Coding applied to Stereo and Multi-Channel Audio Compression", C. Faller, F. Baumgarte, May 2002, Munich, in the IEEE WASPAA Paper "Efficient representation of spatial audio using perceptual parametrization", October 2001, Mohonk, N.Y., and in the 2 ICASSP Papers "Estimation of auditory spatial cues for binaural cue coding", and "Binaural cue coding: a novel and efficient representation of spatial audio", both authored by C. Faller, and F. Baumgarte, Orlando, Fla., May 2002.

In BCC encoding, a number of audio input channels are converted to a spectral representation using a DFT (Discrete Fourier Transform) based transform with overlapping windows. The resulting spectrum is divided into non-overlapping partitions. Each partition has a bandwidth proportional to the equivalent rectangular bandwidth (ERB). The inter-channel level differences (ICLD) and the inter-channel time differences (ICTD) are estimated for each partition. The inter-channel level differences ICLD and inter-channel time differences ICTD are normally given for each channel with respect to a reference channel and furthermore quantized. The transmitted parameters are finally calculated in accordance with prescribed formulae (encoded), which may depend on the specific partitions of the signal to be processed.

At a decoder-side, the decoder receives a mono signal and the BCC bit stream. The mono signal is transformed into the frequency domain and input into a spatial synthesis block, which also receives decoded ICLD and ICTD values. In the spatial synthesis block, the BCC parameters (ICLD and ICTD) values are used to perform a weighting operation of the mono signal in order to synthesize the multi-channel signals, which, after a frequency/time conversion, represent a reconstruction of the original multi-channel audio signal.

In case of BCC, the joint stereo module 60 is operative to output the channel side information such that the parametric channel data are quantized and encoded resulting in ICLD or ICTD parameters, wherein one of the original channels is used as the reference channel while coding the channel side information.

Normally, the carrier channel is formed of the sum of the participating original channels.

Therefore, the above techniques additionally provide a suitable mono representation for playback equipment that can only process the carrier channel and is not able to process the parametric data for generating one or more approximations of more than one input channel.

The audio coding technique known as binaural cue coding (BCC) is also well described in the United States patent application publications US 2003, 0219130 A1, 2003/0026441 A1 and 2003/0035553 A1. Additional reference is also made to "Binaural Cue Coding. Part II: Schemes and Applications", C. Faller and F. Baumgarte, IEEE Trans. on Audio and Speech Proc., Vol. 11, No. 6, November 2003 and to "Binaural cue coding applied to audio compression with flexible rendering", C. Faller and F. Baumgarte, AES 113$^{th}$ Convention, Los Angeles, October 2002. The cited United States patent application publications and the two cited technical publications on the BCC technique authored by Faller and Baumgarte are incorporated herein by reference in their entireties.

Although ICLD and ICTD parameters represent the most important sound source localization parameters, a spatial representation using these parameters only limits the maximum quality that can be achieved. To overcome this limitation, and hence to enable high-quality parametric coding, Parametric stereo (as described in J. Breebaart, S. van de Par, A. Kohlrausch, E. Schuijers (2005) "Parametric coding of stereo audio", Eurasip J. Applied Signal Proc. 9, 1305-1322) applies three types of spatial parameters, referred to as Interchannel Intensity Differences (IIDs), Interchannel Phase Differences (IPDs), and Interchannel Coherence (IC). The extension of the spatial parameter set with coherence parameters enables a parameterization of the perceived spatial 'diffuseness' or spatial 'compactness' of the sound stage.

In the following, a typical generic BCC scheme for multichannel audio coding is elaborated in more detail with reference to FIGS. 12 to 14. FIG. 9 shows such a generic binaural cue coding scheme for coding/transmission of multi-channel audio signals. The multi-channel audio input signal at an input 110 of a BCC encoder 112 is downmixed in a downmix block 114. In the present example, the original multi-channel signal at the input 110 is a 5-channel surround signal having a front left channel, a front right channel, a left surround channel, a right surround channel and a center channel. In a preferred embodiment of the present invention, the downmix block 114 produces a sum signal by a simple addition of these five channels into a mono signal. Other downmixing schemes are known in the art such that, using a multi-channel input signal, a downmix signal having a single channel can be obtained. This single channel is output at a sum signal line 115. A side information obtained by a BCC analysis block 116 is output at a side information line 117. In the BCC analysis block, inter-channel level differences (ICLD), and inter-channel time differences (ICTD) are calculated as has been outlined above. The BCC analysis block 116 is formed to also calculate inter-channel correlation values (ICC values). The sum signal and the side information is transmitted, preferably in a quantized and encoded form, to a BCC decoder 120. The BCC decoder decomposes the transmitted sum signal into a number of subbands and applies scaling, delays and other processing to generate the subbands of the output multi-channel audio signals. This processing is performed such that ICLD, ICTD and ICC parameters (cues) of a reconstructed multi-channel signal at an output 121 are similar to the respective cues for the original multi-channel signal at the input 110 of the BCC encoder 112. To this end, the BCC decoder 120 includes a BCC synthesis block 122 and a side information processing block 123.

In the following, the internal construction of the BCC synthesis block 122 is explained with reference to FIG. 13. The sum signal on line 115 is input into a time/frequency conversion unit or filter bank FB 125. At the output of block 125, a number N of sub band signals are present, or, in an extreme case, a block of spectral coefficients, when the audio filter bank 125 performs a 1:1 transform, i.e., a transform which produces N spectral coefficients from N time domain samples (critical subsampling).

The BCC synthesis block 122 further comprises a delay stage 126, a level modification stage 127, a correlation processing stage 128 and an inverse filter bank stage IFB 129. At the output of stage 129, the reconstructed multi-channel audio signal having for example five channels in case of a 5-channel surround system, can be output to a set of loudspeakers 124 as illustrated in FIG. 12.

As shown in FIG. 13, the input signal s(n) is converted into the frequency domain or filter bank domain by means of element 125. The signal output by element 125 is multiplied such that several versions of the same signal are obtained as illustrated by branching node 130. The number of versions of the original signal is equal to the number of output channels in the output signal to be reconstructed. When, in general, each version of the original signal at node 130 is subjected to a certain delay $d_1, d_2, \ldots, d_i, \ldots, d_N$. The delay parameters are computed by the side information processing block 123 in FIG. 12 and are derived from the inter-channel time differences as determined by the BCC analysis block 116.

The same is true for the multiplication parameters $a_1, a_2, \ldots, a_i, \ldots, a_N$, which are also calculated by the side information processing block 123 based on the inter-channel level differences as calculated by the BCC analysis block 116.

The ICC parameters calculated by the BCC analysis block 116 are used for controlling the functionality of block 128 such that certain correlations between the delayed and level-manipulated signals are obtained at the outputs of block 128. It is to be noted here that the ordering of the stages 126, 127, 128 may be different from the case shown in FIG. 13.

One should be aware that, in a frame-wise processing of an audio signal, the BCC analysis is also performed frame-wise, i.e. time-varying, and also frequency-wise. This means that, for each spectral band, the BCC parameters are obtained individually. This further means that, in case the audio filter bank 125 decomposes the input signal into for example 32 band pass signals, the BCC analysis block obtains a set of BCC parameters for each of the 32 bands. Naturally the BCC synthesis block 122 from FIG. 12, which is shown in detail in FIG. 13, performs a reconstruction, which is also based on the 32 bands in the example.

In the following, reference is made to FIG. 14 showing a setup to determine certain BCC parameters. Normally, ICLD, ICTD and ICC parameters can be defined between arbitrary pairs of channels. One method, that will be outlined here, consists of ICLD and ICTD parameters between a reference channel and each other channel. This is illustrated in FIG. 14A.

ICC parameters can be defined in different ways. Most generally, one could estimate ICC parameters in the encoder between all possible channel pairs as indicated in FIG. 14B. In this case, a decoder would synthesize ICC such that it is approximately the same as in the original multi-channel signal between all possible channel pairs. It was, however, proposed to estimate only ICC parameters between the strongest two channels at a time. This scheme is illustrated in FIG. 14C, where an example is shown, in which at one time instance, an ICC parameter is estimated between channels 1 and 2, and, at another time instance, an ICC parameter is calculated between channels 1 and 5. The decoder then synthesizes the inter-channel correlation between the strongest channels in the decoder and applies some heuristic rule for computing and synthesizing the inter-channel coherence for the remaining channel pairs.

Regarding the calculation of, for example, the multiplication parameters $a_1, \ldots, a_N$ based on transmitted ICLD parameters, reference is made to AES convention paper 5574 cited above. The ICLD parameters represent an energy distribution in an original multi-channel signal. Without loss of generality, it is shown in FIG. 14A that there are four ICLD parameters showing the energy difference between all other channels and the front left channel. In the side information processing block 123, the multiplication parameters $a_1, \ldots, a_N$ are derived from the ICLD parameters such that the total energy of all reconstructed output channels is the same as (or proportional to) the energy of the transmitted sum signal. A simple way for determining these parameters is a 2-stage process, in which, in a first stage, the multiplication factor for the left front channel is set to unity, while multiplication factors for the other channels in FIG. 14A are determined from the transmitted ICLD values. Then, in a second stage, the energy of all five channels is calculated and compared to the energy of the transmitted sum signal. Then, all channels are downscaled using a downscaling factor which is equal for all channels, wherein the downscaling factor is selected such that the total energy of all reconstructed output channels is, after downscaling, equal to the total energy of the transmitted sum signal.

Naturally, there are also other methods for calculating the multiplication factors, which do not rely on the 2-stage process but which only need a 1-stage process.

Regarding the delay parameters, it is to be noted that the delay parameters ICTD, which are transmitted from a BCC encoder can be used directly, when the delay parameter $d_1$ for the left front channel is set to zero. No resealing has to be done here, since a delay does not alter the energy of the signal.

As has been outlined above with respect to FIG. 14, the parametric side information, i.e., the interchannel level differences (ICLD), the interchannel time differences (ICTD) or the interchannel coherence parameter (ICC) can be calculated and transmitted for each of the five channels. This means that one, normally, transmits four sets of interchannel level differences for a five channel signal. The same is true for the interchannel time differences. With respect to the interchannel coherence parameter, it can also be sufficient to only transmit for example two sets of these parameters.

As has been outlined above with respect to FIG. 13, there is not a single level difference parameter, time difference parameter or coherence parameter for one frame or time portion of a signal. Instead, these parameters are determined for several different frequency bands so that a frequency-dependent parametrization is obtained. Since it is preferred to use for example 32 frequency channels, i.e., a filter bank having 32 frequency bands for BCC analysis and BCC synthesis, the parameters can occupy quite a lot of data. Although—compared to other multi-channel transmissions—the parametric representation results in a quite low data rate, there is a continuing need for further reduction of the necessary data rate to represent a signal having more than two channels such as a multi-channel surround signal.

The encoding of a multi-channel audio signal can be advantageously implemented using several existing modules, which perform a parametric stereo coding into a single mono-channel. The international patent application WO2004008805 A1 teaches how parametric stereo coders can be ordered in a hierarchical set-up such, that a given number of input audio channels are subsequently downmixed into one single mono-channel. The parametric side information, describing the spatial properties of the downmix mono-channel, finally consists of all the parametric information subsequently produced during the iterative downmixing process. This means, that, if there are, for example, three stereo-to-mono downmixing processes involved in building the final mono signal, the final set of parameters building the parametric representation of the multi-channel audio signal consists of the three sets of the parameters derived during every single stereo-to-mono downmixing process.

A hierarchical downmixing encoder is shown in FIG. 15, to explain the method of the prior art in more detail. FIG. 15 shows six original audio channels 200*a* to 200*f* that are transformed into a single monophonic audio channel 202 plus parametric side information. Therefore, the six original audio channels 200*a* to 200*f* have to be transformed from the time domain into the frequency domain, which is performed by transforming units 204, transforming the audio channels 200*a* to 200*f* into the corresponding channels 206*a* to 206*f* in the frequency domain. Following the hierarchical approach, the channels 206*a* to 206*f* are pair-wise downmixed into three monophonic channels L, R and C (208*a*, 208*b* and 208*c*, respectively). During the downmixing of the three pairs of channels a parameter set is derived for each channel pair, describing the spatial properties of the original stereophonic signal, downmixed into a monophonic signal. Thus, in this first downmixing step, three parameter sets 210*a* to 210*c* are generated to preserve the spatial information of the signals 206*a* to 206*f*.

In the next step of the hierarchical downmixing, channels 208*a* and 208*b* are downmixed into a channel 212 (LR), generating a parameter set 210*d* (parameter set 4. To finally derive only one single monophonic channel, a downmixing of the channels 208*c* and 212 is necessary, resulting in channel 214 (M). This generates a fifth parameter set 210*e* (parameter set 5). Finally, the downmixed monophonic audio signal 214 is inversely transformed into the time domain to derive an audio signal 202 that can be played by standard equipment.

As described above, a parametric representation of the downmix audio signal 202 according to the prior art consists of all the parameter sets 210*a* to 210*e*, which means that if one wants to rebuild the original multi-channel audio signal (channels 200*a* to 200*f*) from the monophonic audio signal 202, all the parameter sets 210*a* to 210*e* are required as side information of the monophonic downmix signal 202.

The U.S. patent application Ser. No. 11/032,689 (from here only referred to as "prior art cue combination") describes a process for combining several cue values into a single transmitted one in order to save side information in a nonhierarchical coding scheme. To do so, all the channels are downmixed first and the cue codes are later on combined to form transmitted cue values (could also be one single value), the combination being dependent on a predefined mathematical function, in which the spatial parameters, that are derived directly from the input signals, are put in as variables.

State-of-the-art techniques for the parametric coding of two ("stereo") or more ("multi-channel") audio input channels derive the spatial parameters directly from the input signals. Examples of such parameters are inter-channel level differences (ICLD) or inter-channel intensity differences (IID), inter-channel time delay (ICTD) or inter-channel phase differences (IPD), and inter-channel correlation/coherence (ICC), each of which are transmitted in a frequency-selective fashion, i.e. per frequency band. The application of the prior art cue combination teaches that several cue values can be combined to a single value that is transmitted from the encoder to the decoder side. The decoding process uses the transmitted single value instead of the originally individually transmitted cue values to reconstruct the multi-channel output signal. In a preferred embodiment, this scheme has been applied to the ICC parameters. It has been shown that this leads to a considerable reduction in the size of the cue side information while preserving the spatial quality of the vast majority of signals. It is, however, not clear how this can be exploited in a hierarchical coding scheme.

The patent application on prior art cue combination has detailed the principle of the invention by an example for a system based on two transmitted downmix channels. In the proposed method, with reference to FIG. 15, ICC values of Lf/Lr and Rf/Rr channel pairs are combined into a single transmitted ICC parameter. The two combined ICC values have been obtained during the downmixing of a front-left channel Lf and a rear-left channel Lr into the channel L and during the downmixing of a front-right Rf and a rear-right channel Rr into the channel R. Therefore, the two combined ICC values that are finally being combined into the single transmitted ICC parameter, both carry information about the front/back correlation of the original channels and a combination of these two ICC values will generally preserve most of this information. If one would have to further downmix the L and R channels into one single mono channel, one would get a third ICC value, carrying information about the left/right correlation of the downmix channels L and R. According to the cue combination of prior art, one would now have to combine the three ICC values applying a given function transforming the three ICC values into one transmitted ICC parameter.

One has the problem then that front/back information mixes with left/right information, which is obviously disadvantageous for a reproduction of the original multi-channel audio signal. In the U.S. application Ser. No. 11/032,689, this is avoided by transmitting two downmix channels, the L and R channels, that hold the left/right information, and additionally transmitting one single ICC value, holding front/back information. This preserves the spatial properties of the original channels at the cost of a substantially increased data rate, resulting from the full additional downmix channel to be transmitted.

SUMMARY OF THE INVENTION

It is the object of the present invention to provide an improved concept to generate and to use a parametric representation of a multi-channel audio signal with compact side information in the context of a hierarchical coding scheme In accordance with the first aspect of the present invention, this object is achieved by an encoder for generating a parametric representation of an audio signal having at least two original left channels on a left side and two original right channels on a right side with respect to a listening position, comprising: a generator for generating parametric information, the generator being operative to separately process several pairs of channels to derive a level information for processed channel pairs, and to derive coherence information for a channel pair including a first channel only having information from the left side and a second channel only having information from the right side, and a provider for providing the parametric representation by selecting the level information for channel pairs and determining a left/right coherence measure using the coherence information.

In accordance with a second aspect of the present invention, this object is achieved by a decoder for processing a parametric representation of an original audio signal, the original audio signal having at least two original left channels on a left side and at least two original right channels on a right side with respect to a listening position, comprising: a receiver for providing the parametric representation of the audio signal, the receiver being operative to provide level information for channel pairs and to provide a left/right coherence measure for a channel pair including a left channel and a right channel, the left/right coherence measure representing a coherence information between at least one channel pair including a first channel only having information from the left side and a second channel only having information from the right side; and a processor for supplying parametric information for channel pairs, the processor being operative to select level information from the parametric representation and to derive coherence information for at least one channel pair using the left/right coherence measure, the at least one channel pair including a first channel only having information from the left side and a second channel only having information from the right side.

In accordance with a third aspect of the present invention, this object is achieved by a method for generating a parametric representation of an audio signal.

In accordance with a fourth aspect of the present invention, this object is achieved by a computer program implementing the above method, when running on a computer.

In accordance with a fifth aspect of the present invention, this object is achieved by a method for processing a parametric representation of an original audio signal.

In accordance with a sixth aspect of the present invention, this object is achieved by a computer program implementing the above method, when running on a computer.

In accordance with a seventh aspect of the present invention, this object is achieved by encoded audio data generated by building a parametric representation of an audio signal having at least two original left channels on a left side and two original right channels on a right side with respect to a listening position, wherein the parametric representation comprises level differences for channel pairs and a left/right coherence measure derived from coherence information from a channel pair including a first channel only having information from the left side and a second channel only having information from the right side.

The present invention is based on the finding that a parametric representation of a multi-channel audio signal sdescribes the spatial properties of the audio signal well using compact side information, when the coherence information, describing the coherence between a first and a second channel, is derived within a hierarchical encoding process only for channel pairs including a first channel having only information of a left side with respect to a listening position and including a second channel having only information from a right side with respect to a listening position. As in the hierarchical process the multiple audio channels of the original audio signal are downmixed iteratively preferably into a monophonic channel, one has the chance to pick the relevant side-information parameters during the encoding process for a step involving only channel pairs that bear the desired information needed to describe the spatial properties of the original audio signal as good as possible. This allows to build a parametric representation of the original audio signal on the basis of those picked parameters or on a combination of those parameters, allowing a significant reduction of the size of the side information, that is holding the spatial information of the downmix signal.

The proposed concept allows combining cue values to reduce the side information rate of a downmix audio signal even for the case where only a single (monophonic) transmission channel is feasible. The inventive concept even allows different hierarchical topologies of the encoder. It is specifically clarified, how a suitable single ICC value can be derived, which can be applied in a spatial audio decoder using the hierarchical encoding/decoding approach to reproduce the original sound image faithfully.

One embodiment of the present invention implements a hierarchical encoding structure that combines the left front and the left rear audio channel of a 5.1 channel audio signal into a left master channel and that simultaneously combines the right front and the right rear channel into a right master channel. Combining the left channels and the right channels separately, the important left/right coherence information is mainly preserved and is, according to the invention, derived in the second encoding step, in which the left master and the right master channels are downmixed into a stereo master channel. During this down-mixing process the ICC parameter for the whole system is derived, since this ICC parameter will be the ICC parameter resembling with most accuracy the left/right coherence. Within this embodiment of the present invention, one gets an ICC parameter, describing the most important left/right coherence of the six audio channels by simply arranging the hierarchical encoding steps in an appropriate way and not by applying some artificial function to a set of ICC parameters, describing arbitrary pairs of channels, as it is the case in the prior art techniques.

In a modification of the described embodiment of the present invention, the center channel and the low frequency channel of the 5.1 audio signal are downmixed into a center master channel, this channel holding mainly information about the center channel, since the low frequency channel contains only signals with such a low frequency that the origin of the signals can hardly be localized by humans. It can be advantageous to additionally steer the ICC value, derived as described above, by parameters describing the center master channel. This can be done, for example, by weighting the ICC value with energy information, the energy information telling how much energy is transmitted via the center master channel with respect to the stereo master channel.

In a further embodiment of the present invention, the hierarchical encoding process is performed such, that in a first step the left-front and right-front channels of a 5.1 audio signal are downmixed into a front master channel, whereas the left-rear and the right-rear channels are down-mixed into a rear master channel. Therefore, in each of the downmixing processes an ICC value is generated, containing information about the important left/right coherence. The combined and transmitted ICC parameter is then derived from a combination of the two separate ICC values, an advantageous way of deriving the transmitted ICC parameter is to build the weighted sum of the ICC values, using the level parameters of the channels as weights.

In a modification of the invention, the center channel and the low frequency channel are downmixed into a center master channel and afterwards the center master channel and the front master channel are downmixed into a stereo master channel. In the latter downmixing process, a correlation between the center and the stereo channels is received, which is used to steer or modify a transmitted ICC parameter, thus also taking into account the center contribution to the front audio signal. A major advantage of the previously described system is that one can build the coherence information such that channels, that contribute most to the audio signal, mainly define the transmitted ICC value. This will normally be the front channels, but for example in a multi-channel representation of a music concert, the signal of the applauding audience could be emphasized by mainly using the ICC value of the rear channels. It is a further advantage that the weighting between the front and the back channels can be varied dynamically, depending on the spatial properties of the multichannel audio signal.

In one embodiment of the present invention an inventive hierarchical decoder is operative to receive less ICC parameters than required by the number of existing decoding steps. The decoder is operational to derive the ICC parameters required for each decoding step from the received ICC parameters.

This might be done deriving the additional ICC parameters using a deriving rule that is based on the received ICC parameters and the received ICLD values or by using predefined values instead.

In a preferred embodiment, however, the decoder is operational to use a single transmitted ICC parameter for each individual decoding step. This is advantageous as the most important correlation, the left/right correlation is preserved in a transmitted ICC parameter within the inventive concept. As this is the case, a listener will experience a reproduction of the signal that is resembling the original signal very well. It is to be remembered that the ICC parameter is defining the perceptual wideness of a reconstructed signal. If the decoder would modify a transmitted ICC parameter after transmission, the ICC parameters describing the perceptual wideness of the reconstructed signal may become rather different for the left/right and for the front/back correlation within the hierarchical reproduction. This would be most disadvantageous since then, a listener that moves or rotates his head will experience a signal that becomes perceptually wider or narrower, which is of course most disturbing. This can be avoided by distributing a single received ICC parameter to the decoding units of a hierarchical decoder.

In another preferred embodiment, an inventive decoder is operational to receive a full set of ICC values or alternatively a single ICC value, wherein the decoder recognizes the decoding strategy to apply by receiving a strategy indication within the bitstream. Such the backwards compatible decoder is also operational in prior art environments, decoding prior art signals transmitting a full set of ICC data.

BRIEF DESCRIPTION OF THE DRAWINGS

Preferred embodiments of the present invention are subsequently described by referring to the enclosed drawings, wherein:

FIG. 2 shows an embodiment of an inventive audio encoder;

FIG. 7 shows another embodiment of an inventive audio decoder;

DETAILED DESCRIPTION OF PREFERRED EMBODIMENTS

Figure 1:
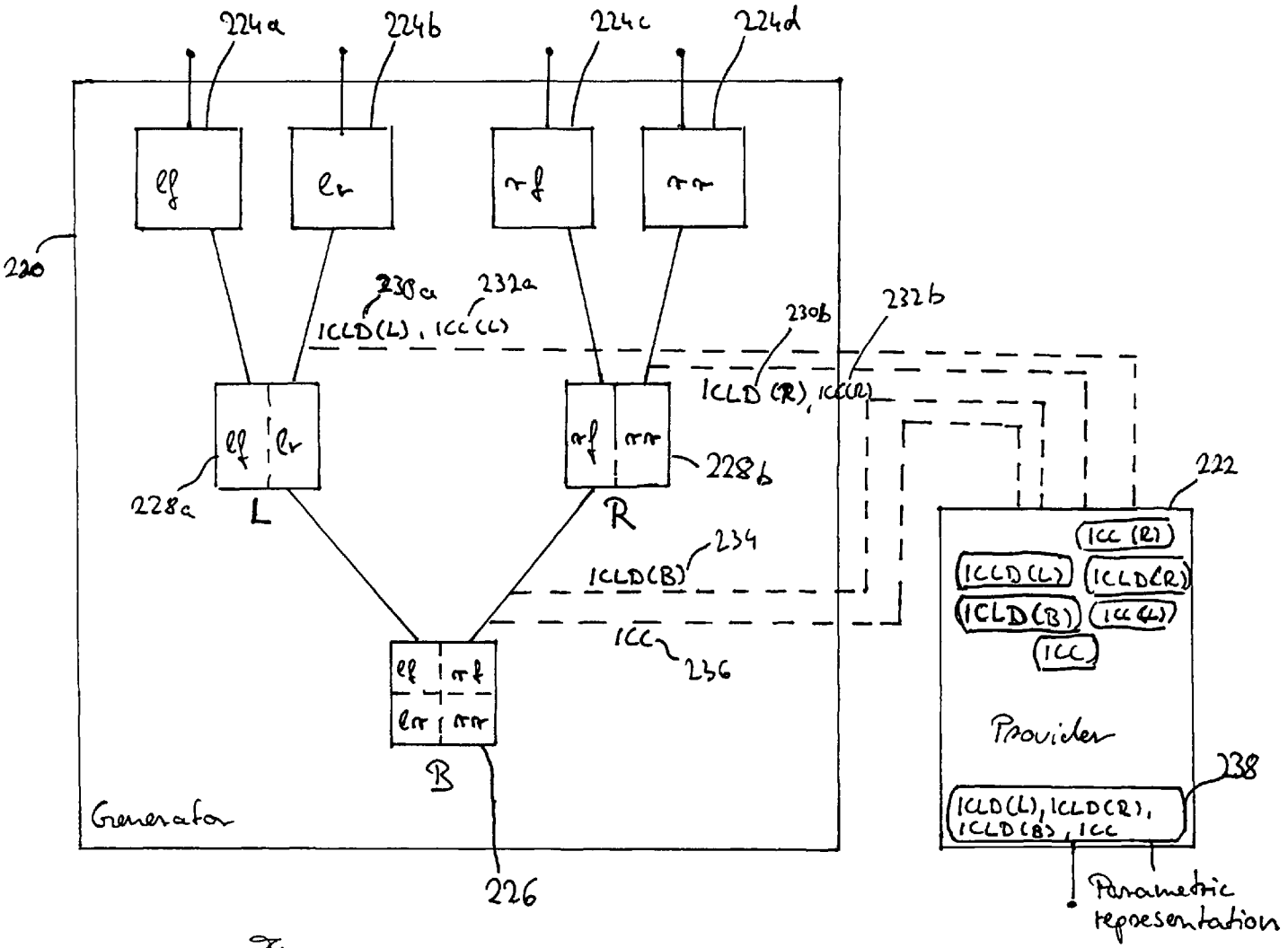
FIG. 1 shows a block diagram of an embodiment of the inventive hierarchical audio encoder.
Figure 3:
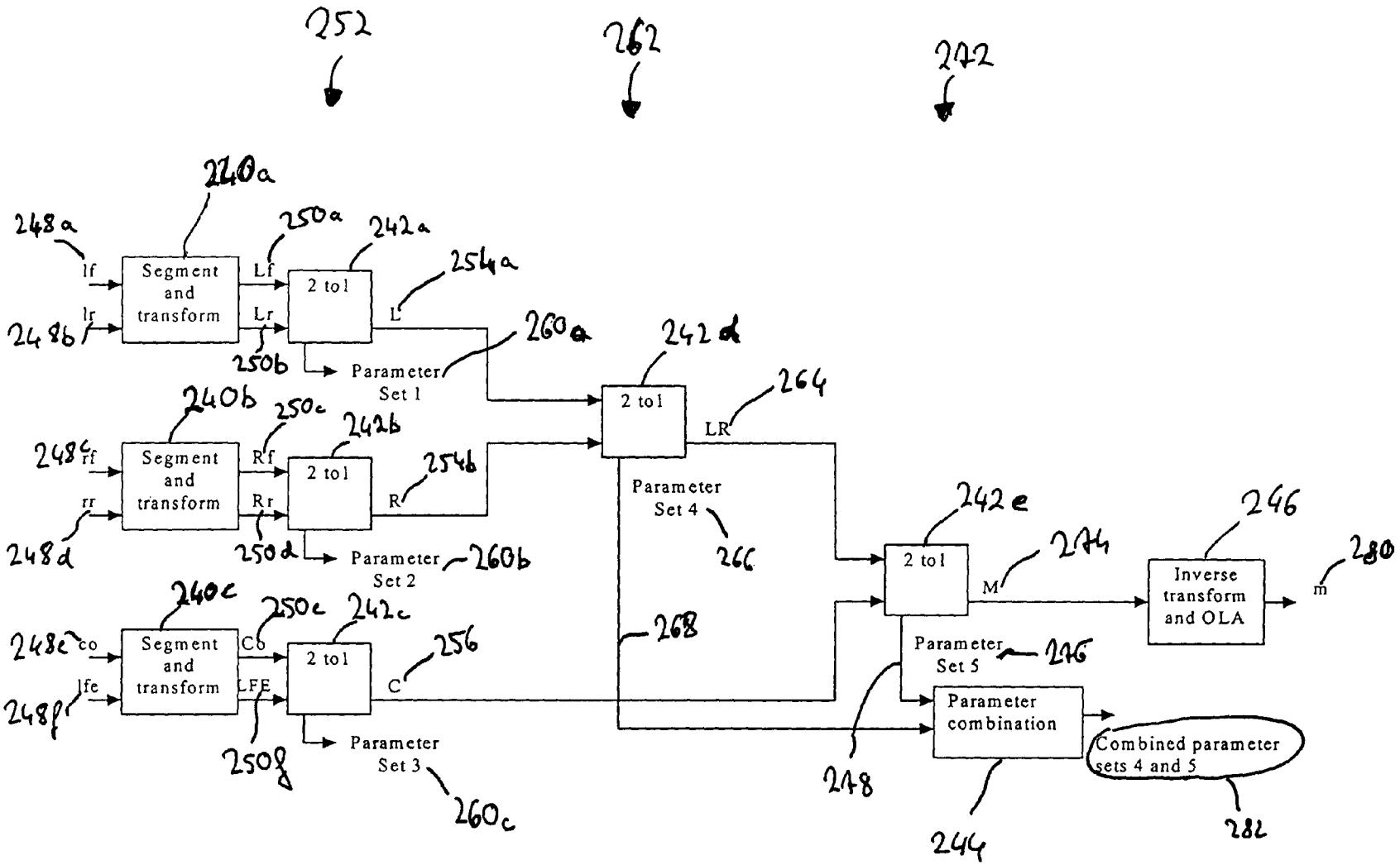
FIG. 3*a,b* shows graphical representations of side channel information.

FIG. 1 shows a block diagram of an inventive encoder to generate a parametric representation of an audio signal. FIG. 1 shows a generator 220 to subsequently combine audio channels and generate spatial parameters describing spatial properties of pairs of channels that are combined into a single channel. FIG. 1 further shows a provider 222 to provide a parametric representation of a multi-channel audio signal by selecting level difference information between channel pairs and by determining a left/right coherence measure using coherence information generated by the generator 220.

To demonstrate the principle of the inventive concept of hierarchical multi-channel audio coding, FIG. 1 shows a case, where four original audio channels 224*a* to 224*d* are iteratively combined, resulting in a single channel 226. The original audio channels 224*a* and 224*b* represent the left-front and the left-rear channel of an original four-channel audio signal, the channels 224*c* and 224*d* represent the right-front and the right-rear channel, respectively. Without loss of generality, only two of various spatial parameters are shown in FIG. 1 (ICLD and ICC). According to the invention, the generator 220 combines the audio channels 224*a* to 224*d* in such a way that during the combination process an ICC parameter can be derived that carries the important left/right coherence information.

In a first step, the channels containing only left side information 224*a* and 224*b* are combined into a left master channel 228*a* (L) and the two channels containing only right side information 224*c* and 224*d* are combined into a right master channel 228*b* (R). During this combination the generator generates two ICLD parameters 230*a* and 230*b*, both being spatial parameters containing information about the level difference of two original channels being combined into one single channel. The generator also generates two ICC parameters 232*a* and 232*b*, describing the correlation between the two channels being combined into a single channel. The ICLD and ICC parameters 230*a*, 230*b*, 232*a*, and 232*b* are transferred to the provider 222.

In the next step of the hierarchical generation process, the left master channel 228*a* is combined with the right master channel 228*b* into the resulting audio channel 226, wherein the generator provides an ICLD parameter 234 and an ICC parameter 236, both of them being transmitted to the provider 222. It is important to note that the ICC parameter 236 generated in this combination step mainly represents the important left/right coherence information of the original four-channel audio signal represented by the audio channels 224*a* to 224*d*.

Therefore, the provider 222 builds a parametrical representation 238 from the available spatial parameters 230*a,b*, 232*a, b*, 234 and 236 such, that the parametrical representation comprises the parameters 230*a*, 230*b*, 234, and 236.

FIG. 2 shows a preferred embodiment of an inventive audio encoder that encodes a 5.1 multi-channel signal into a single monophonic signal.

FIG. 2 shows three transformation units 240*a* to 240*c*, five 2-to-1-downmixers 242*a* to 242*e*, a parameter combination unit 244 and an inverse transformation unit 246. The original 5.1 channel audio signal is given by the left-front channel 248*a*, the left-rear channel 248*b*, the right-front channel 248*c*, the right-rear channel 248*d*, the center channel 248*e*, and the low-frequency channel 248*f*. It is important to note that the original channels are grouped in such a way that the channels containing only left side information 248*a* and 248*b* form one channel pair, the channels containing only right side information 248*c* and 248*d* form another channel pair and that the center channel 248*e* and 248*f* are forming a third channel pair. The transformation units 240*a* to 240*c* convert the channels 248*a* to 248*f* from the time domain into their spectral representation 250*a* to 250*f* in the frequency subband domain. In the first hierarchical encoding step 252, the left channels 250*a* and 250*b* are encoded into a left master channel 254*a*, the right channels 250*c* and 250*d* are encoded into a right master channel 254*b* and the center channel 250*e* and the low frequency channel 250*f* are encoded into a center master channel 256. During this first hierarchic encoding step 252, the three involved 2-to-1-encoders 242*a* to 242*c* generate the downmixed channels 254*a*, 254*b*, and 256, and in addition the important spatial parameter sets 260*a*, 260*b*, and 260*c*, wherein the parameter set 260*a* (parameter set 1) describes the spatial information between channels 250*a* and 250*b*, the parameter set 260*b* (parameter set 2) describes the spatial relation between channels 250*c* and 250*d* and the parameter set 260*c* (parameter set 3) describes the spatial relation between channels 250*e* and 250*f*.

In a second hierarchical step 262, the left master channel 254*a* and the right master channel 254*b* are downmixed into a stereo master channel 264, generating a spatial parameter set 266 (parameter set 4), wherein the ICC parameter, of this parameter set 266 contains the important left/right correlation information. To build a combined ICC value from parameter set 266, the parameter set 266 can be transferred to the parameter combination unit 244 via a data connection 268. In the third hierarchical encoding step 272, the stereo master channel 264 is combined with the center master channel 256 to form a monophonic result channel 274. The parameter set 276, that is derived during this downmixing process, can be transferred via a data connection 278 to the parameter combination unit 244. Finally, the result channel 274 is transformed into the time domain by the inverse transformation unit 246, to build the monophonic downmix audio signal 280, which is the final monophonic phonic representation of the original 5.1 channel signal represented by the audio channels 248*a* to 248*f*.

Figure 2A:
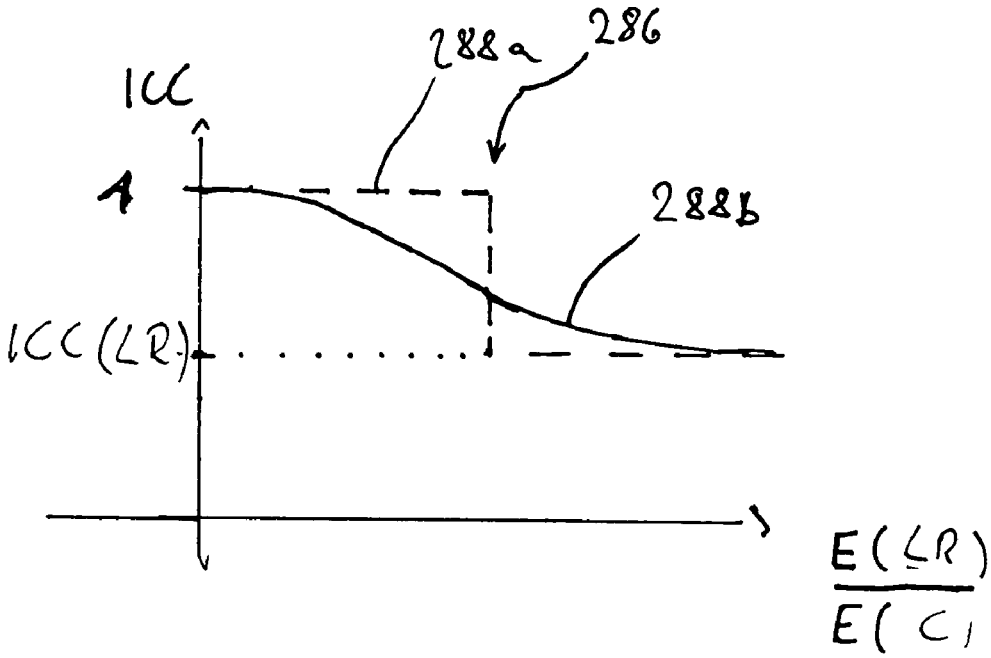
FIG. 2*a* shows a possible steering scheme of an IIC parameters of an inventive audio encoder.

To reconstruct the original 5.1 channel audio signal from the monophonic downmix audio channel 280, the parametric representation of the 5.1 channel audio signal is additionally needed. For the tree structure shown in FIG. 2, it can be seen that the left front and back channels are combined into an L-signal 254*a*. Similarly, the right front and back channels are combined into an R-signal 254*b*. Subsequently, the combination of the L and R-signals is carried out, which delivers parameter set number 4 (266). In the case of this hierarchical structure, a simple way of deriving a combined ICC value is to pick the ICC value of parameter set number 4 and take this as combined ICC value, which is then incorporated into the parametric representation of the 5.1 channel signal by the parameter combination unit 244. More sophisticated methods can also take into account the influence of the center channel (e.g. by using parameters from parameter set number 5), as shown in FIG. 2*a*.

As an example, the energy ratio E(LR)/E(C) of the energy contained in the LR (264) channel and in the C channel (256) from parameter set number 5 can be used to steer the ICC of value. In case most of the energy comes from the LR path, the transmitted ICC value should become close to the ICC value ICC(LR) of parameter set number 4. In case most of the energy comes from the C-path 256, the transmitted ICC value should become subsequently close to 1, as indicated in FIG. 2*a*. The Figure shows two possible ways to implement this steering of the ICC Parameter either by switching between two extreme values when the energy ratio crosses a given threshold 286 (steering function 288*a*) or by a smooth transition between the extreme values (steering function 288*b*).

Figure 3A:
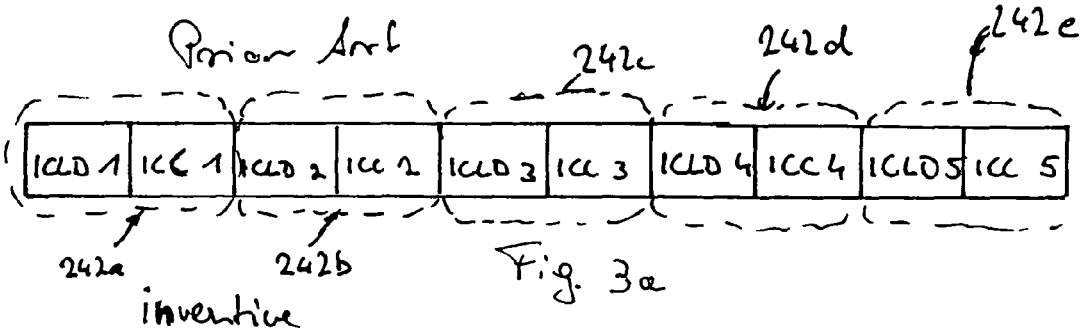
Figure 3B:
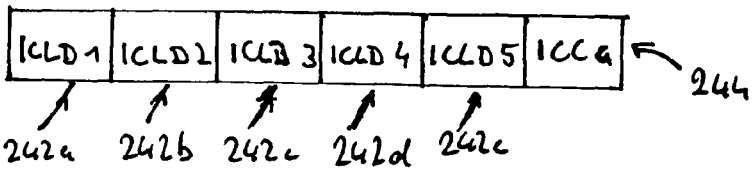

FIGS. 3*a* and 3*b* show a comparison of a possible parametric representation of a 5.1 audio channel delivered from a hierarchical encoder structure using a prior art technique (FIG. 3*a*) and using the inventive concept for audio coding (FIG. 3*b*).

FIG. 3*a* shows a parametric representation of a single time frame and a discrete frequency interval, as it would be provided by the prior art technique. Each of the 2-to-1 encoders 242*a* to 242*e* from FIG. 2 delivers one pair of ICLD and ICC parameters, the origin of the parameter pairs is indicated within FIG. 3*a*. Following the prior art approach, all parameter sets, as provided by the 2-to-1 encoders 242*a* to 242*e* have to be transmitted together with the downmix monophonic audio signal 280 as side information to rebuild a 5.1 channel audio signal.

FIG. 3*b* shows parameters derived following the inventive concept. Each of the 2-to-1 encoders 242*a* to 242*e* contributes only one parameter directly, the ICLD parameter. The single transmitted ICC parameter ICCC is derived by the parameter combination unit 244, and not provided directly by the 2-to-1 encoders 242*a* to 242*e*. As it is clearly seen in the FIGS. 3*a* and 3*b*, the inventive concept for a hierarchical encoder can reduce the amount of side information data significantly compared to prior art techniques.

Figure 4:
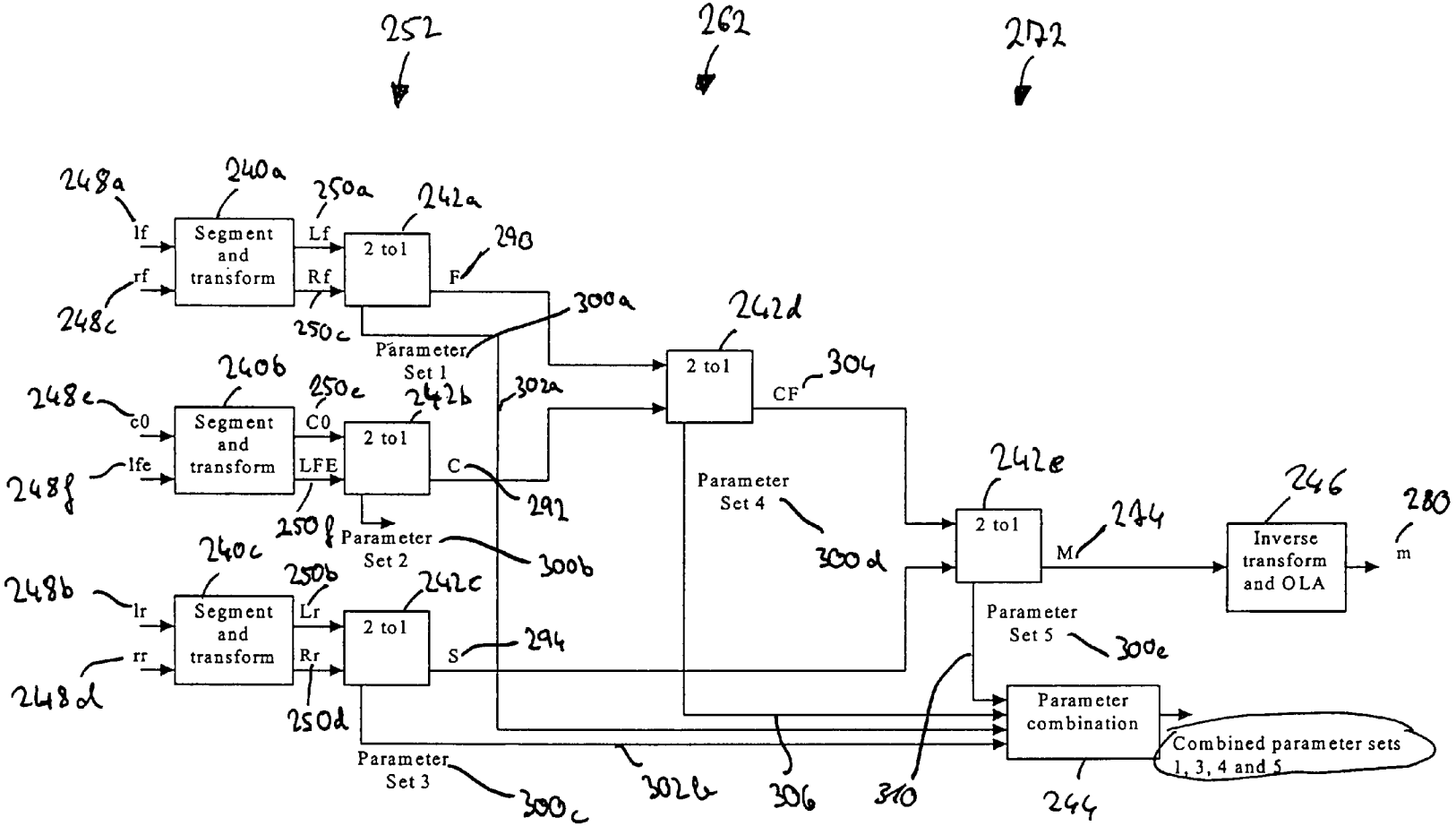
FIG. 4 shows a second embodiment of an inventive audio encoder.

FIG. 4 shows another preferred embodiment of the current invention, allowing to encode a 5.1 channel audio signal into a monophonic audio signal in a hierarchical encoding process and to supply compact side information. As the principle hardware structure is equal to the one described in FIG. 2, the same items in the two figures are labeled with the same numbers. The difference is due to the different grouping of the input channels 248*a* to 248*f* and hence the order, in which the single channels are downmixed into the monophonic channel 274 differs from the downmixing order in FIG. 2. Therefore, only the aspects differing from the description of FIG. 2, which are vital for the understanding of the embodiment of the current invention shown in FIG. 4, are described in the following.

The left-front channel 248*a* and the right-front channel 248*c* are grouped together to form a channel pair, the center channel 248*e* and the low-frequency channel 248*f* form another input channel pair and the third input channel pair of the 5.1 audio signal is formed by the left-rear channel 248*b* and the right-rear channel 248*d*.

In a first hierarchical encoding step 252, the left-front channel 250*a* and the right-front channel 250*c* are downmixed into a front master channel 290 (F), the center channel 250*e* and the low-frequency channel 250*f* are downmixed into a center master channel 292 (C) and the left-rear channel 250*b* and the right-rear channel 250*d* are downmixed into a rear master channel 294 (S). A parameter set 300*a* (parameter set 1) describes the front master channel 290, a parameter set 300*b* (parameter set 2) describes the center master channel 292, and a parameter set 300*c* (parameter set 3) describes the rear master channel 294.

It is important to note that the parameter set 300*a* as well as the parameter set 300*c* hold information that describes the important left/right correlation between the original channels 248*a* to 248*f*. Therefore, parameter set 300*a* and parameter set 300*c* is made available to the parameter combination unit 244 via data links 302*a* and 302*b*.

In a second encoding step 262, the front master channel 290 and the center master channel 292 are downmixed into a pure front channel 304, generating a parameter set 300*d* (parameter set 4). This parameter set 300*d* is also made available to the parameter combination unit 244 via a data link 306.

In a third hierarchical encoding step 272, the pure front channel 304 is downmixed with the rear master channel 294 into the result channel 274 (M), which is then transformed into the time domain by the inverse transformation unit 246 to form the final monophonic downmix audio channel 280. The parameter set 300*e* (Parameter Set 5), originating from the downmixing of the pure front channel 304 and the rear master channel 294 is also made available to the parameter combination unit 244 via a data link 310.

The tree structure in FIG. 4 first performs a combination of the left and right channels separately for front and rear. Thus, basic left/right correlation/coherence is present in the parameter sets 1 and 3 (300*a*, 300*c*). A combined ICC value could be built by the parameter combination unit 244 by building the weighted average between the ICC values of parameter sets 1 and 3. This means that more weight will be given to stronger channel pairs (Lf/Rf versus Lr/Rr). One can achieve the same by deriving a combined ICC Parameter ICCC building the weighted sum:

$$ICC_C=(A*ICC_1+B*ICC_2)/(A+B)$$

wherein A denotes the energy within the pair of channels corresponding to $ICC_1$ and B denotes the energy within the pair of channels corresponding to $ICC_2$.

In an alternative embodiment, more sophisticated methods can also take into account the influence of the center channel (e.g. by taking into account parameters of the parameter set number 4).

Figure 5:
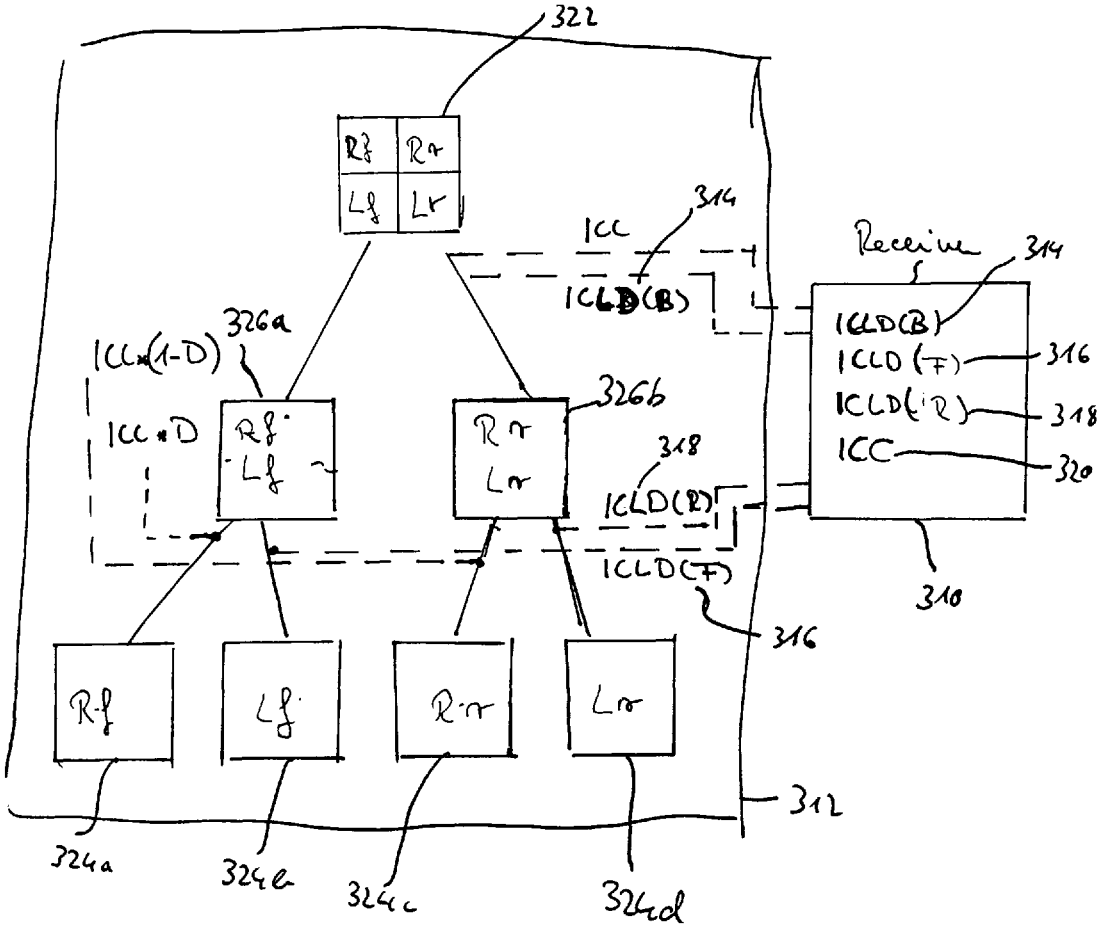
FIG. 5 shows a block diagram of a preferred embodiment of an inventive audio decoder.

FIG. 5 shows an inventive decoder, to process received compact side information, being a parametric representation of an original four-channel audio signal. FIG. 5 comprises a receiver 310 to provide a compact parametric representation of the four-channel audio signal and a processor 312 to process the compact parametric representation such that a full parametric representation of the four-channel audio signal is supplied, which enables one to reconstruct the four-channel audio signal from a received monophonic audio signal.

The receiver 310 receives the spatial parameters ICLD (B) 314, ICLD (F) 316, ICLD (R) 318 and ICC 320. The provided parametric representation, consisting of the parameters 314 to 320, describes the spatial properties of the original audio channels 324*a* to 324*d*.

As a first up-mixing step, the processor 312 supplies the spatial parameters describing a first channel pair 326*a*, being a combination of two channels 324*a* and 324*b* (Rf and Lf) and a second channel pair 326*b*, being a combination of two channels 324*c* and 324*d* (Rr and Lr). To do so, the level difference 314 of the channel pairs is required. Since both channel pairs 326*a* and 326*b* contain a left channel as well as a right channel, the difference between the channel pairs describes mainly a front/back correlation. Therefore, the received ICC parameter 320, carrying mainly information about the left/right coherence, is provided by the processor 312 such that the left/right coherence information is preferably used to supply the individual ICC parameters for the channel pairs 326*a* and 326*b*.

In the next step, the processor 312 supplies appropriate spatial parameters to be able to reconstruct the single audio channels 324*a* and 324*b* from channel 326*a*, and the channels 324*c* and 324*d* from channel 326*b*. To do so, the processor 312 supplies the level differences 316 and 318, and the processor 312 has to supply appropriate ICC values for the two channel pairs, since each of the channel pairs 326*a* and 326*b* contains important left/right coherence information.

In one example, the processor 312 could simply provide the combined received ICC value 320 to up-mix channel pairs 326*a* and 326*b*. Alternatively, the received combined ICC value 320 could be weighted to derive individual ICC values for the two channel pairs, the weights being for example based on the level difference 314 of the two channel pairs.

In a preferred embodiment of the present invention, the processor provides the received ICC parameter 320 for every single upmixing step to avoid the introduction of additional artefacts during the reproduction of the channels 324*a* to 324*d*.

Figure 6:
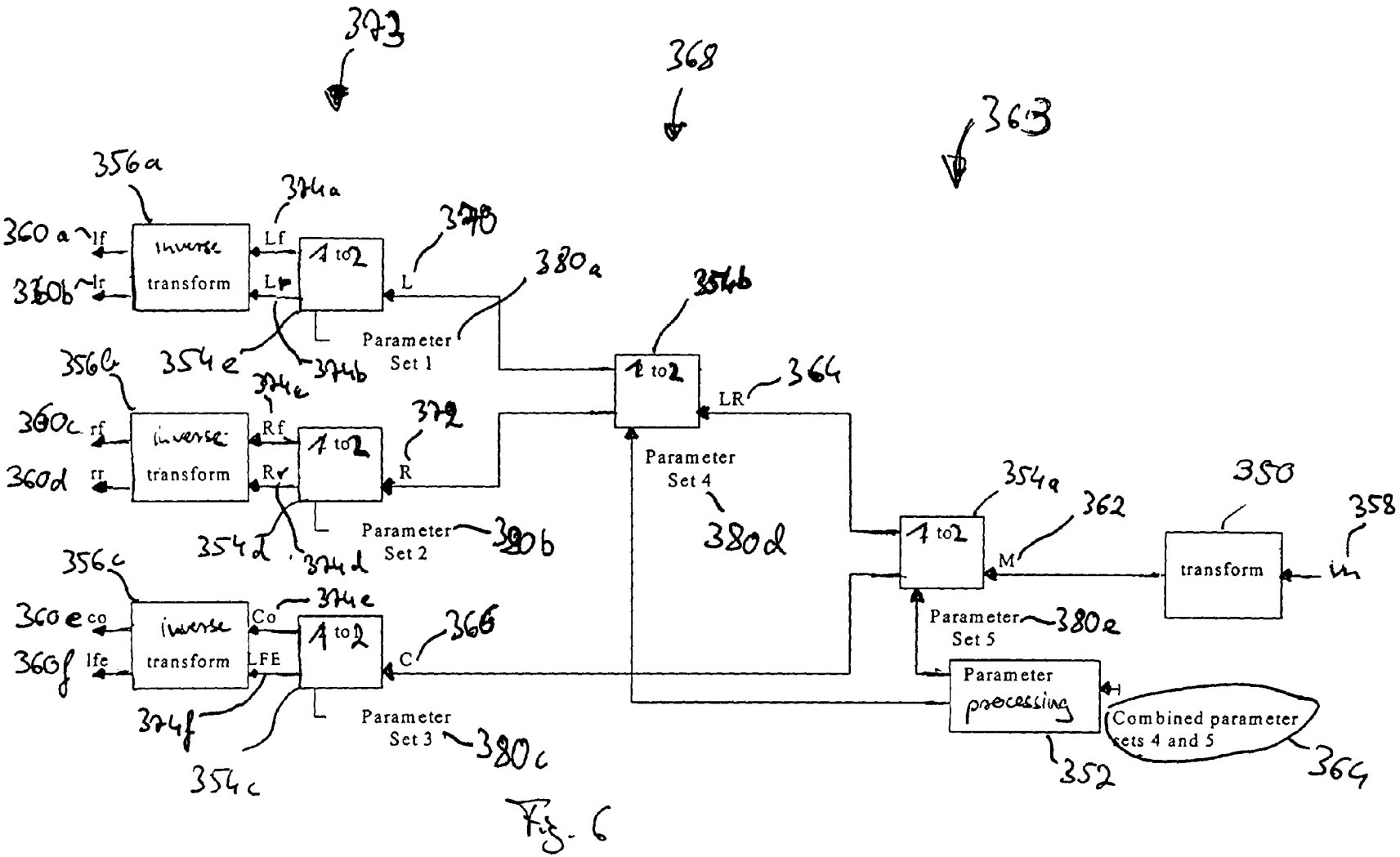
FIG. 6 shows an embodiment of an inventive audio decoder.
Figure 4:
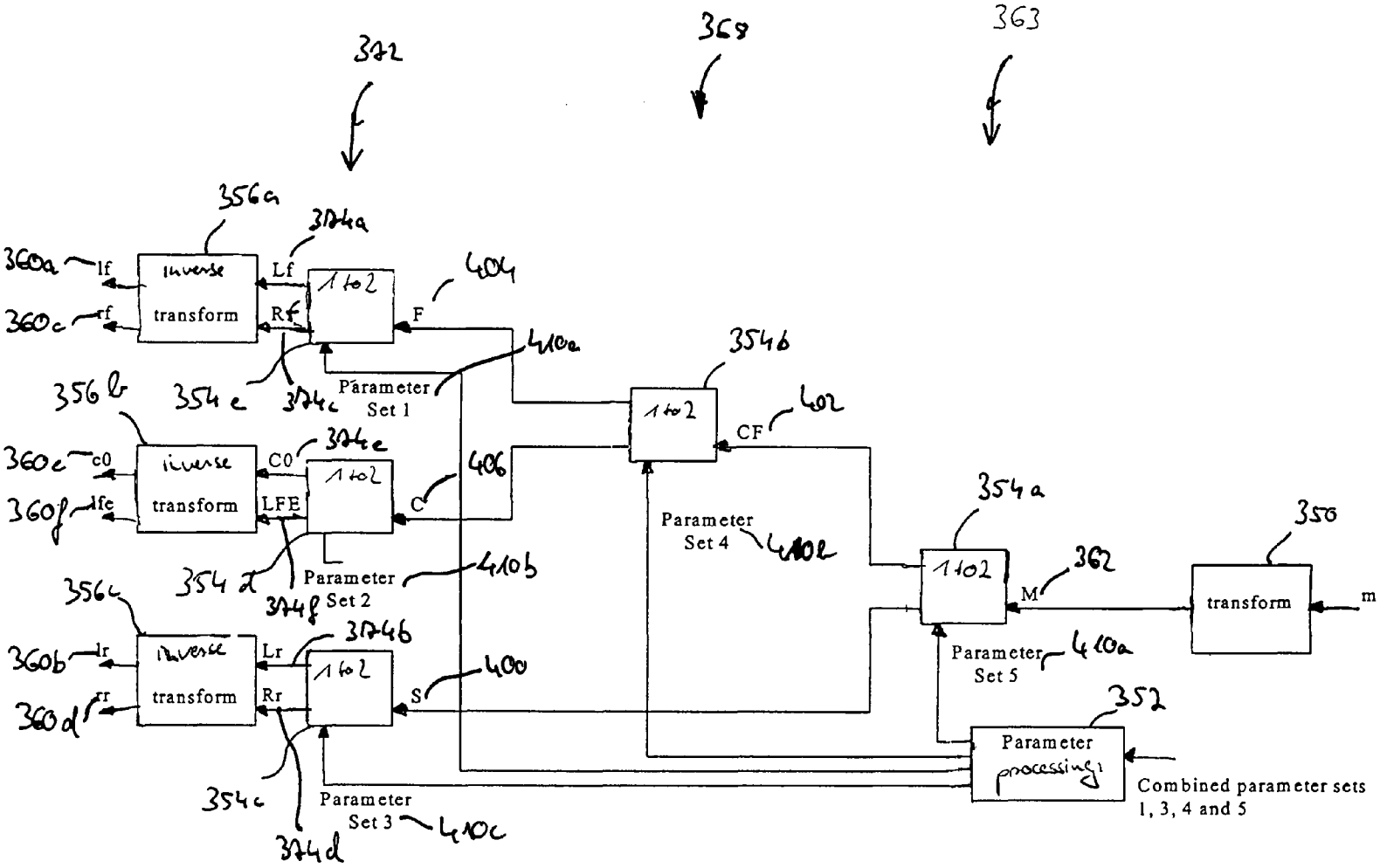

FIG. 6 shows a preferred embodiment of a decoder incorporating a hierarchical decoding procedure according to the current invention, to decode a monophonic audio signal to a 5.1 multi-channel audio signal, making use of a compact parametric representation of an original 5.1 audio signal.

FIG. 6 shows a transforming unit 350, a parameter-processing unit 352, five 1-to-2 decoders 354*a* to 354*e* and three inverse transforming units 356*a* to 356*c*.

It should be noted that the embodiment of an inventive decoder according to FIG. 6 is the counterpart of the encoder described in FIG. 2 and designed to receive a monophonic downmix audio channel 358, which shall finally be up-mixed into a 5.1 audio signal consisting of audio channels 360*a* (lf), 360*b* (lr), 360*c* (rf), 360*d* (rr), 360*e* (co) and 360*f* (lfe). The downmix channel 358 (m) is received and transformed from the time domain to the frequency domain into its frequency representation 362 using the transforming unit 350. The parameter-processing unit 352 receives a combined and compact set of spatial parameters 364 in parallel with the downmix channel 358.

In a first step 363 of the hierarchical decoding process, the monophonic downmix channel 362 is up-mixed into a stereo master channel 364 (LR) and a center master channel 366 (C).

In a second step 368 of the hierarchical decoding process, the stereo master channel 364 is up-mixed into a left master channel 370 (L) and a right master channel 372 (R).

In a third step of the decoding process, the left master channel 370 is up-mixed into a left-front channel 374*a* and a left-rear channel 374*b*, the right master channel 372 is up-mixed into a right-front channel 374*c* and right-rear channel 374*d*, and the center master channel 366 is up-mixed to a center channel 374*e* and a low-frequency channel 374*f*.

Finally, the six single audio channels 374*a* to 374*f* are transformed by the inverse transforming units 356*a* to 356*c* into their representation in the time domain and thus build the reconstructed 5.1 audio signal, having six audio channels 360*a* to 360*f*. To retain the original spatial property of the 5.1 audio signal, the parameter processing unit 352, especially the way the parameter processing unit provides the individual parameter sets 380*a* to 380*e*, is vital, especially the way the parameter processing unit 352 derives the individual parameter sets 380*a* to 380*e*.

The received combined ICC parameter describes the important left/right coherence of the original six channel audio signal. Therefore, the parameter processing unit 352 builds the ICC value of parameter set 4 (380*d*) such that it resembles the left/right correlation information of the originally received spatial value, being transmitted within the parameter set 364. In the simplest possible implementation the parameter processing unit 352 simply uses the received combined ICC parameter.

Another preferred embodiment of a decoder according to the current invention is shown in FIG. 7, the decoder in FIG. 7 being the counterpart of the encoder from FIG. 4.

As the encoder in FIG. 7 comprises the same functional blocks as the decoder in FIG. 6, the following discussion is limited to the steps in which the hierarchical decoding process differs from the one in FIG. 6. This is mainly due to the fact that the monophonic signal 362 is up-mixed in a different order and a different channel combination, since the original 5.1 audio signal had been downmixed differently than the one received in FIG. 6.

In the first step 363 of the hierarchical decoding process, the monophonic signal 362 is up-mixed into a rear master channel 400 (S) and a pure front channel 402 (CF).

In a second step 368, the pure front channel 402 is up-mixed into a front master channel 404 and a center master channel 406.

In a third decoding step 372, the front master channel is up-mixed into a left-front channel 374*a* and a right-front channel 374*c*, the center master channel 406 is up-mixed into a center channel 374*e* and a low-frequency channel 374*f* and the rear master channel 400 is up-mixed into a left-rear channel 374*b* and a right-rear channel 374*d*. Finally, the six audio channels 374*a* to 374*f* are transformed from the frequency domain into their time-domain representations 360*a* to 360*f*, building the reconstructed 5.1 audio signal.

To preserve the spatial properties of the original 5.1 signal, having been coded as side information by the encoder, the parameter processing unit 352 supplies the parameter sets 410*a* to 410*e* for the 1-to-2 decoders 354*a* to 354*e*. As the important left/right correlation information is needed in the third up-mixing process 372 to build the Lf, Rf, Lr, and Rr channels, the parameter-processing unit 352 may supply an appropriate ICC value in the parameter sets 410*a* and 410*c*, in the simplest implementation simply taking the transmitted ICC parameter to build the parameter sets 410*a* and 410*c*. In a possible alternative, the received ICC parameter could be transformed into individual parameters for parameter sets 410*a* and 410*c* by applying a suitable weighting function to the received ICC parameter, their weight being for example dependent on the energy transmitted in the front master channel 404 and in the rear master channel 400. In an even more sophisticated implementation, the parameter-processing unit 352 could also take into account center channel information to supply an individual ICC value for parameter set 5 and parameter set 4 (410*a*, 410*b*).

Figure 8:
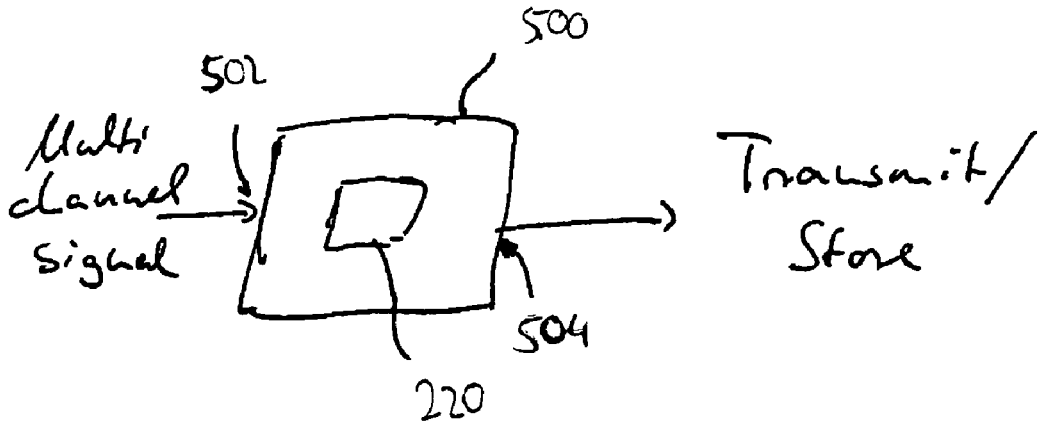
FIG. 8 shows an inventive transmitter or audio recorder.

FIG. 8 is showing an inventive audio transmitter or recorder 500 that is having an encoder 220, an input interface 502 and an output interface 504.

An audio signal can be supplied at the input interface 502 of the transmitter/recorder 500. The audio signal is encoded using an inventive encoder 220 within the transmitter/recorder and the encoded representation is output at the output interface 504 of the transmitter/recorder 500. The encoded representation may then be transmitted or stored on a storage medium.

Figure 9:
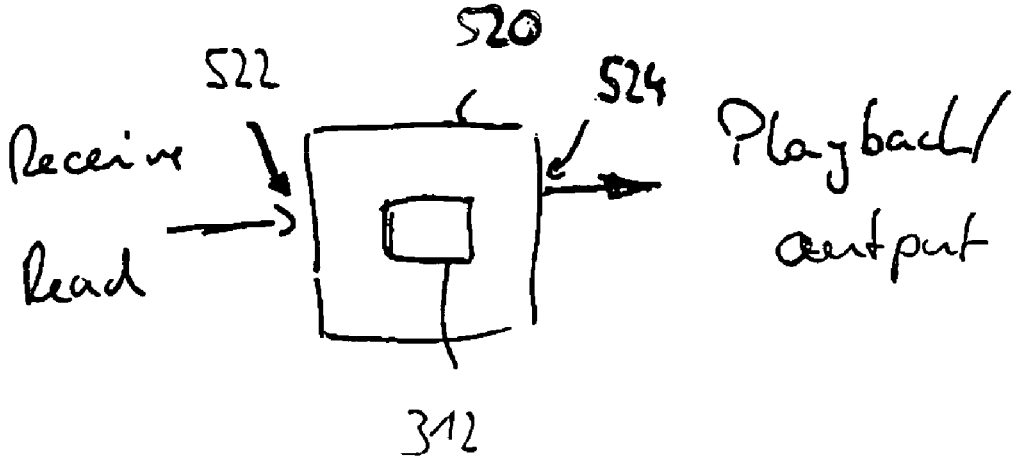
FIG. 9 shows an inventive receiver or audio player.

FIG. 9 shows an inventive receiver or audio player 520, having an inventive decoder 312, a bit stream input 522, and an audio output 524.

A bit stream can be input at the input 522 of the inventive receiver/audio player 520. The bit stream then is decoded using the decoder 312 and the decoded signal is output or played at the output 524 of the inventive receiver/audio player 520.

Figure 10:
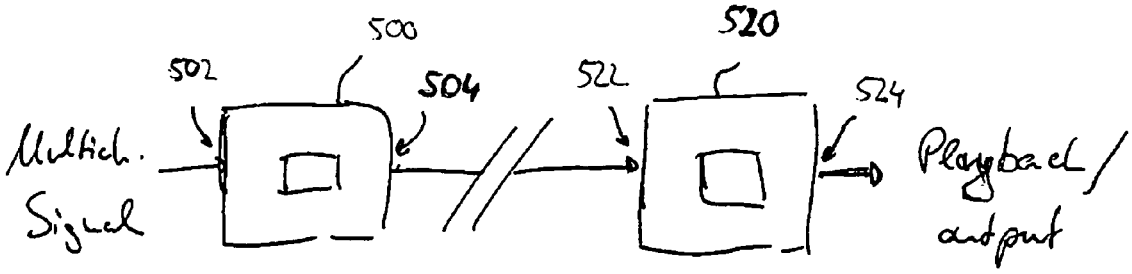
FIG. 10 shows an inventive transmission system.
Figure 11:
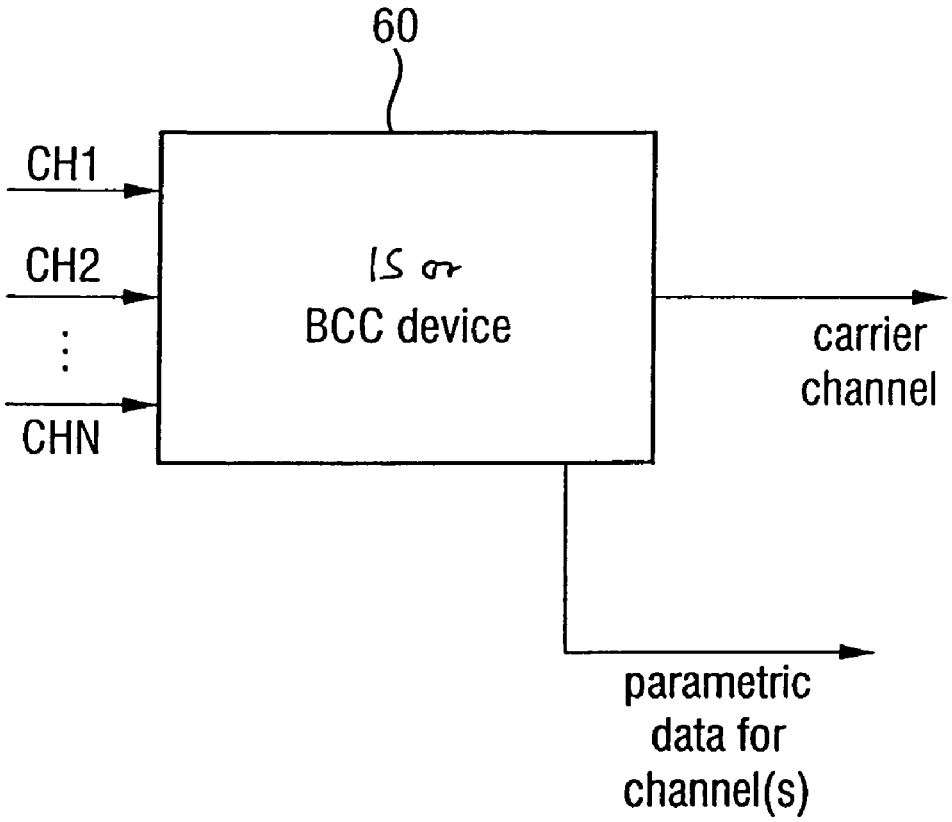
FIG 11 (Prior Art)
FIG. 11 shows a prior art joint stereo encoder.
Figure 12:
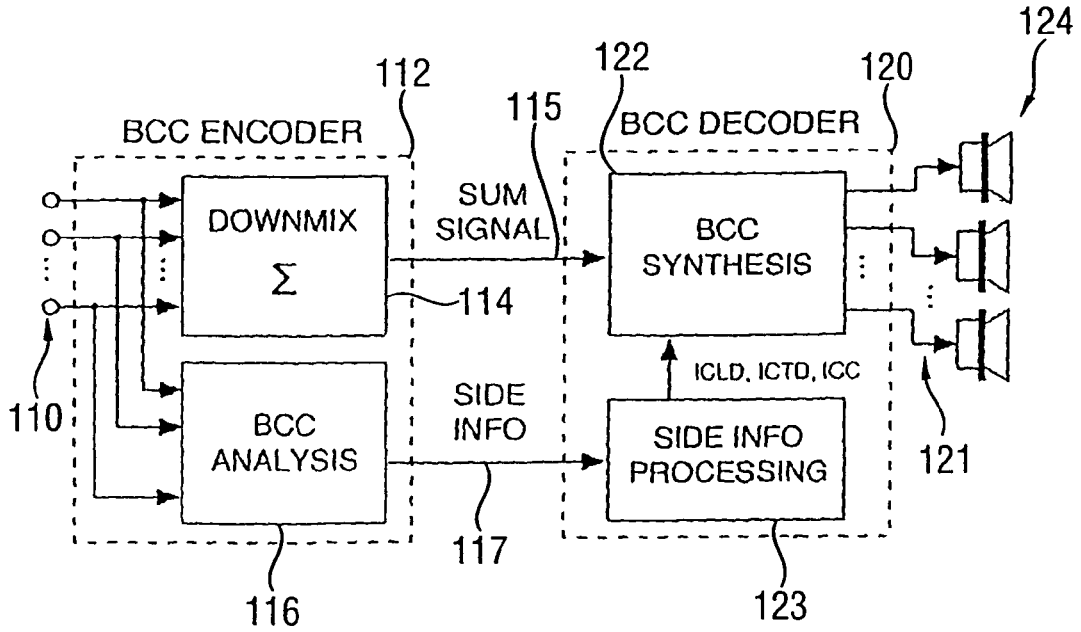
FIG 12 (Prior Art)
FIG. 12 shows a block diagram representation of a prior art BCC encoder/decoder chain.
Figure 13:
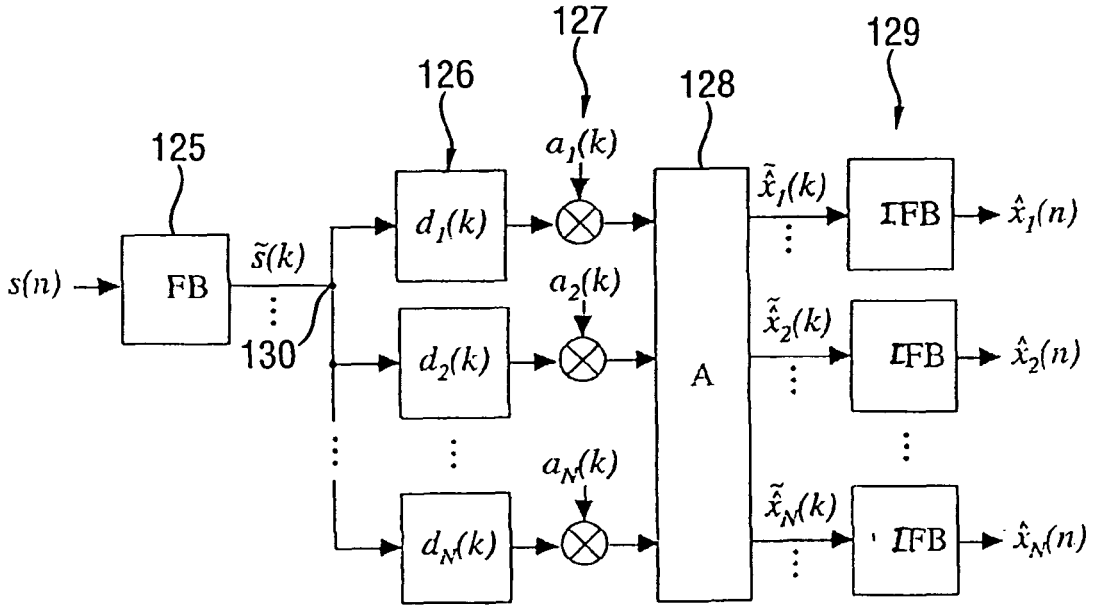
FIG 13 (Prior Art)
FIG. 13 shows a block diagram of a prior art implementation of a BCC synthesis block.
Figure 14:
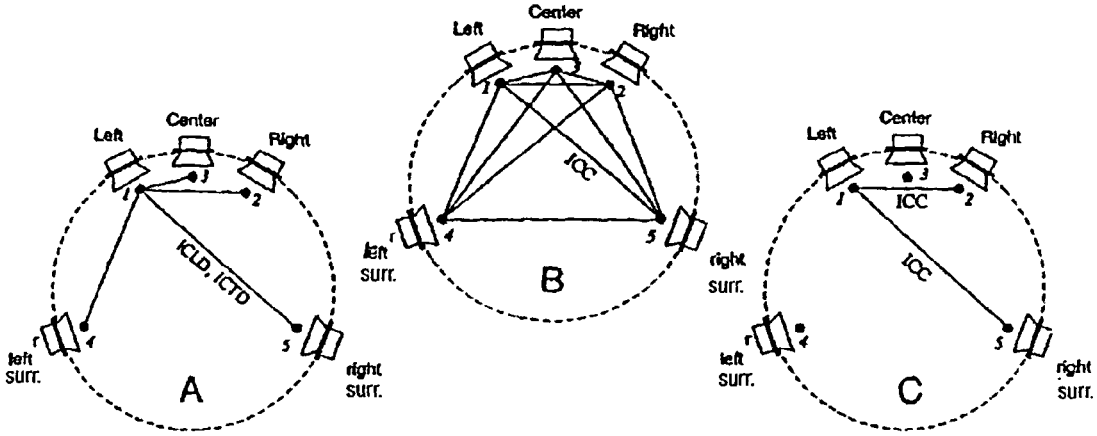
FIG 14 (Prior Art)
FIG. 14 shows a representation of a scheme for determining BCC parameters.

FIG. 10 shows a transmission system comprising an inventive transmitter 500, and an inventive receiver 520.

The audio signal input at the input interface 502 of the transmitter 500 is encoded and transferred from the output 504 of the transmitter 500 to the input 522 of the receiver 520. The receiver decodes the audio signal and plays back or outputs the audio signal on its output 524.

The discussed examples of inventive decoders downmix a multi-channel audio signal into a monophonic audio signal. It is of course alternatively possible to downmix a multi-channel signal into a stereophonic signal, which would for example mean for the embodiments discussed in FIGS. 2 and 4, that one step in the hierarchical encoding process could be by-passed. All other numbers of resulting channels are also possible.

The proposed method to hierarchically encode or decode multi-channel audio information providing/using a compact parametric representation of the spatial properties of the audio signal is described mainly by shrinking the side information by combining multiple ICC values into one single transmitted ICC value. It is to note here that the described invention is in no way limited to the use of just one combined ICC value. Instead, e.g., two combined values can be generated, one describing the important left/right correlation, the other one describing a front/back correlation.

This can advantageously be implemented, for example, in the embodiment of the current invention shown in FIG. 2, where on the one hand a left front channel 250*a* and a left rear channel 250*b* is combined into a left master channel 254*a*, and where a right front channel 250*c* and a right rear channel 250*d* is combined into a rear master channel 254*b*. These two encoding steps therefore yield information about the front back correlation of the original audio signal, which can easily be processed to provide an additional ICC value, holding front/back correlation information.

Furthermore, in a preferred modification of the current invention, it is advantageous to have encoding/decoding processes, which can do both, use the prior art individually transmitted parameters, and, depending on a signaling side information that is sent from encoder to decoder, also use combined transmitted parameters. Such a system can advantageously achieve both, higher representation accuracy (using individually transmitted parameters) and, alternatively, a low side information bit rate (using combined parameters).

Typically, the choice of this setting is made by the user depending on the application requirements, such as the amount of side information that can be accommodated by the transmission system used. This allows to use the same unified encoder/decoder architecture while being able to operate within a wide range of side information bit rate/precision trade-offs. This is an important capability in order to cover a wide range of possible applications with differing requirements and transmission capacity.

In another modification of such an advantageous embodiment, the choice of the operating mode could also be made automatically by the encoder, which analyses for example the deviation of the decoded values from the ideal result in case the combined transmission mode was used. If no significant deviation is found, then combined parameter transmission is employed. A decoder could even decide himself, based on an analysis of the provided side information, which mode is the appropriate one to use. For example, if there were just one spatial parameter provided, the decoder would automatically switch into the decoding mode using combined transmitted parameters.

In another advantageous modification of the current invention, the encoder/decoder switches automatically from the mode using combined transmitted parameters to the mode using individually transmitted parameters, to ensure the best possible compromise between an audio reproduction quality and a desired low side information bit rate.

As can be seen from the described preferred embodiments of the encoders/decoders in FIGS. 2, 4, 6, and 7, these units make use of the same functional blocks. Therefore, another preferred embodiment builds an encoder and a decoder using the same hardware within one housing.

In an alternative embodiment of the current invention it is possible to dynamically switch between the different encoding schemes by grouping different channels together as channel pairs, making it possible to dynamically use the encoding scheme that provides the best possible audio quality for the given multi-channel audio signal.

It is not necessary to transmit the monophonic downmix channel alongside the parametric representation of a multi-channel audio signal. It is also possible to transmit the parametric representation alone, to enable a listener, who already owns a monophonic downmix of the multi-channel audio signal, for example as a record, to reproduce a multi-channel signal using his existing multi-channel equipment and a parametric side information.

To summarize, the present invention allows to determine these combined parameters advantageously from known prior art parameters. Applying the inventive concept of combining parameters in a hierarchical encoder/decoder structure, one can downmix a multi-channel audio signal into a mono-based parametric representation, obtaining a precise parametrization of the original signal at a low side information rate (=bit-rate reduction).

It is one objective of the present invention that the encoder combines certain parameters with the objective of reducing the number of parameters that have to be transmitted. Then, the decoder derives the missing parameters from parameters that have been transmitted, instead of using default parameter values, as it is the case in systems of prior art, for example the one being shown in FIG. 15.

Figure 15:
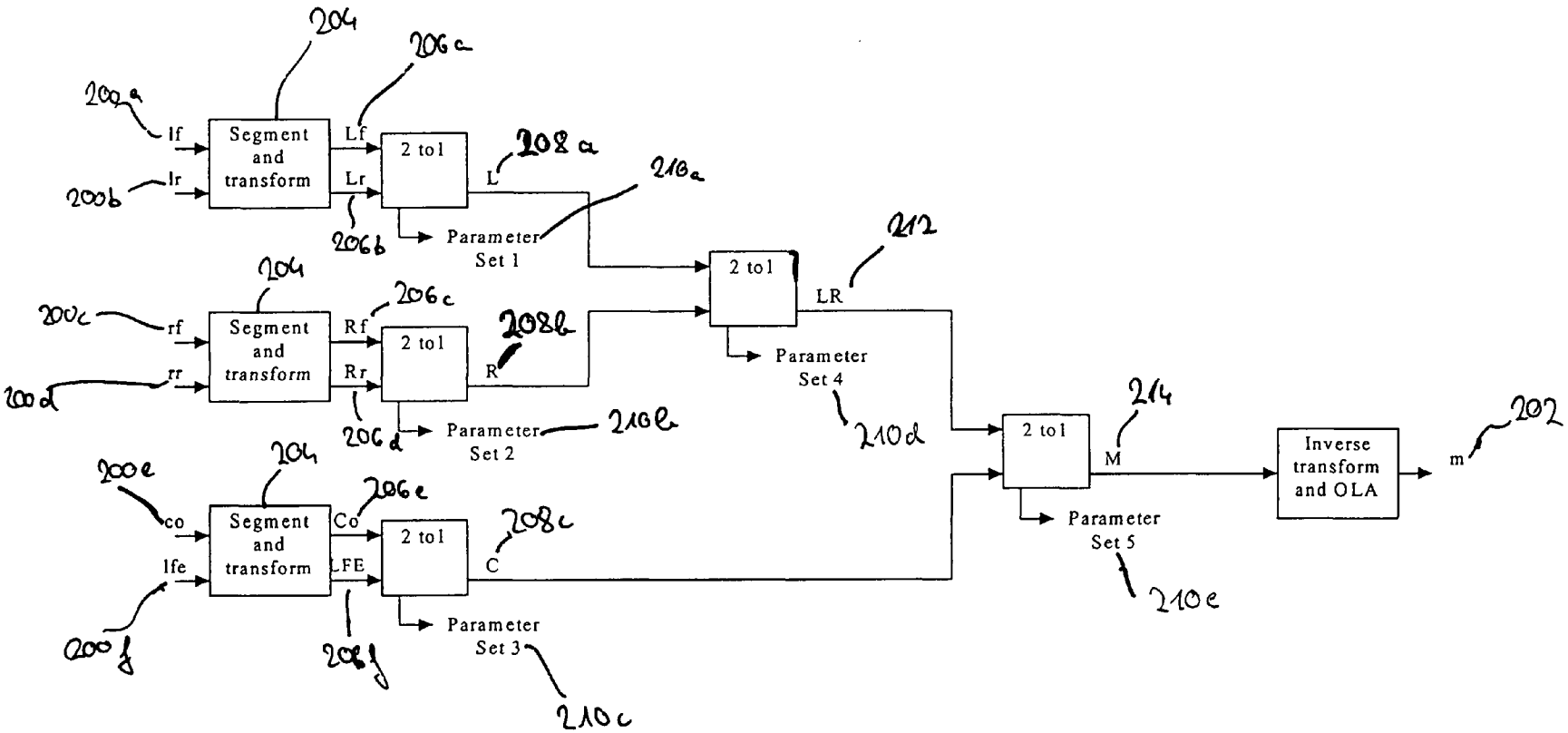
FIG. 15 (Prior Art)
FIG. 15 shows a prior art hierarchical encoder.

This advantage becomes evident reviewing again the embodiment of a hierarchical parametric multi-channel audio coder using prior art techniques, an example shown in FIG. 15. There, the input signals (Lf, Rf, Lr, Rr, C and LFE, corresponding to the left front, right front, left rear, right rear, center and low frequency enhancement channels, respectively) are segmented and transformed to the frequency domain to obtain the required time/frequency tiles. The resulting signals are subsequently combined in a pair-wise fashion. For example, the signals Lf and Lr are combined to form signal "L". A corresponding spatial parameter set (1) is generated to model the spatial properties between the signals Lf and Lr (i.e. consisting of one or more of IIDs, ICCs, IPDs). In the embodiment according to the prior art shown in FIG. 15, this process is repeated until a single output channel (M) is obtained, the output channel being accompanied by five parameter sets. The application of prior art hierarchical coding techniques would then imply the transmission of all parameter sets.

It should be noted, however, that not all parameter sets have to contain values for all possible spatial parameters. For example, parameter set 1 in FIG. 15 may consist of IID and ICC parameters, while parameter set 3 may consist of IDD parameters only. If certain parameters are not transmitted for specific sets, the prior art hierarchical decoder will apply a default value for these parameters (for example ICC=+1, IPD=0, etc.). Thus, each parameter set represents a specific signal combination only and does not describe spatial properties of the remaining channel pairs.

This loss of knowledge about the spatial properties of signals, who's parameters are not being transmitted, can be avoided using the inventive concept, in which the encoder is combining specific parameters such that the most important spatial properties of the original signal are preserved.

When, for example, ICC parameters are combined into a single value, the combined parameters can be used in the decoder as a substitute for all individual parameters (or the individual parameter used in the decoder can be derived from the transmitted ones). It is an important feature that the encoder parameter combination process is carried out such that the sound image of the original multi-channel signal is preserved as closely as possible after reconstruction by the decoder. Transmitting ICC parameters, this means that the width (decorrelation) of the original sound field should be retained.

It is to be noted here that the most important ICC value is between the left/right axis since the listener usually is facing forward in the listening set-up. This can be taken into account advantageously to build the hierarchical encoding structure such that a suitable parametric representation of the audio signal can be obtained during the iterative encoding process, wherein the resulting combined ICC value represents mainly the left/right decorrelation. This will be explained in more detail later when discussing preferred embodiments of the current invention.

The inventive encoding/decoding scheme allows to reduce the number of transmitted parameters from a encoder to a decoder using a hierarchical structure of a spatial audio system by means of the two following measures:

combining the individual encoder parameters to form a combined parameter, which is transmitted to the decoder instead of individual ones. The combination of the parameters is carried out such that the signal sound image (including L/R correlation/coherence) is preserved as far as possible.

the transmitted combined parameter is used in the decoder instead of several transmitted individual parameters (or the actually used parameters are derived from the combined one).

Depending on certain implementation requirements of the inventive methods, the inventive methods can be implemented in hardware or in software. The implementation can be performed using a digital storage medium, in particular a disk, DVD or a CD having electronically readable control signals stored thereon, which cooperate with a programmable computer system such that the inventive methods are performed. Generally, the present invention is, therefore, a computer program product with a program code stored on a machine readable carrier, the program code being operative for performing the inventive methods when the computer program product runs on a computer. In other words, the inventive methods are, therefore, a computer program having a program code for performing at least one of the inventive methods when the computer program runs on a computer.

While the foregoing has been particularly shown and described with reference to particular embodiments thereof, it will be understood by those skilled in the art that various other changes in the form and details may be made without departing from the spirit and scope thereof. It is to be understood that various changes may be made in adapting to different embodiments without departing from the broader concepts disclosed herein and comprehended by the claims that follow.

What is claimed is:

1. An encoder for generating a parametric representation of an audio signal having at least two original left channels on a left side and two original right channels on a right side with respect to a listening position, comprising:

a generator for generating parametric information, the generator being operative to separately process several pairs of channels to derive a level information for processed channel pairs, and to derive coherence information for a channel pair including a first channel only having information from the left side and a second channel only having information from the right side; and a provider for providing the parametric representation by selecting the level information for channel pairs and by determining a left/right coherence measure using the coherence information and to introduce the left/right coherence measure into an output datastream as the only coherence information of the audio signal within the parametric representation.

2. The encoder in accordance with claim 1, in which the generator is operative to process a left-front channel lf and a left-rear channel lr to derive a lf/lr level information, wherein a combination of the left-front channel lf and the left-rear lr channel forms a left master channel LM, and to process a right-front channel rf and a right-rear channel rr to derive a rf/rr level information, wherein a combination of the right-front channel rf and the right-rear rr channel forms a right master channel RM; and to process the left master channel LM and the right master channel RM to derive a lm/rm level information and to derive the coherence information, wherein a combination of the left master channel LM and the right master channel RM forms a stereo master channel SM.

3. The encoder in accordance with claim 2, in which the generator is operative to process a center channel ce and a low-frequency channel lo to derive a ce/lo level information, wherein a combination of the center channel ce and the low-frequency channel lo forms a center master channel CM.

4. The encoder in accordance with claim 3, in which the generator is operative to process the stereo master channel SM and the center master channel CM to derive a sm/cm level information, wherein a combination of the stereo master channel SM and the center master CM channel forms a downmix channel; and in which the provider is operative to determine the left/right coherence measure using the coherence information and the sm/cm level information.

5. The encoder in accordance with claim 4, in which the provider is operative to calculate the left/right coherence measure depending on the sm/cm level information such that, in a case, in which the sm/cm level information indicates, that more energy is in the stereo master channel SM than in the center master channel CM, the left/right coherence measure is more close to the coherence information compared to a situation, in which the sm/cm level information indicates, that more energy is in the center master channel CM, in which case the left/right coherence measure is more close to unity.

6. The encoder in accordance with claim 4, in which the provider is operative to calculate the left/right coherence measure depending on the sm/cm level information such that, in a case, in which the sm/cm level information indicates, that a ratio of the energy in the stereo master channel SM and the energy in the center master channel CM exceeds a predefined value, the left/right coherence measure is set to the coherence information compared to a situation, in which the sm/cm level information indicates, that the ratio of the energy in the stereo master channel SM to the energy in the center master channel CM stays below or equals the predefined value, in which the left/right coherence measure is set to unity.

7. The encoder in accordance with claim 1, in which the generator is operative to process a left-front channel lf and a right-front channel rf to derive a lf/rf level information and a first coherence information, wherein a combination of the left-front channel lf and the right-front channel rf forms a front master channel FM, and to process a left-rear channel lr and a right-rear channel rr to derive a lr/rr level information and to derive a second coherence information, wherein a combination of the left-rear channel lr and the right-rear channel rr forms a rear master channel RM, and in which the provider is operative to determine the left/right coherence measure combining the first coherence information and the second coherence information.

8. The encoder in accordance with claim 7, in which the provider is operative to determine the left/right coherence measure based on a weighted sum of the first and the second coherence information, using level information of the front master channel FM and level information of the rear master channel RM as weights.

9. The encoder in accordance with claim 7, in which the generator is operative to process a center channel ce and a low-frequency channel lo to derive a ce/lo level information, wherein a combination of the center channel ce and the low-frequency channel lo forms a center master channel CM.

10. The encoder in accordance with claim 9, in which the generator is operative to process the front master channel FM and the center master channel CM to derive a fm/cm level information, wherein a combination of the front master channel FM and the center master channel CM forms a pure front channel PF; and in which the provider is operative to determine the left/right coherence measure combining the first and the second coherence information additionally using the fm/cm level information.

11. The encoder in accordance with claim 10, in which the generator is operative to process the pure front channel PF and the rear master channel RM to derive a pf/rm level information, wherein a combination of the pure front channel PF and the rear master channel RM forms a downmix channel.

12. The encoder in accordance with claim 1, in which the generator is operative to process the pairs of channels in discrete time frames of a given length.

13. The encoder in accordance with claim 1, in which the generator is operative to process the pairs of channels in discrete frequency intervals of a given bandwidth.

14. A decoder for processing a parametric representation of an original audio signal, the original audio signal having at least two original left channels on a left side and at least two original right channels on a right side with respect to a listening position, comprising:

a receiver for providing the parametric representation of the audio signal, the receiver being operative to provide level information for channel pairs and to provide a left/right coherence measure for a channel pair including a left channel and a right channel as the only coherence information of the original audio signal within the parametric representation, the left/right coherence measure representing a coherence information between at least one channel pair including a first channel only having information from the left side and a second channel only having information from the right side; and a processor for supplying parametric information for channel pairs, the processor being operative to select level information from the parametric representation and to derive coherence information for at least one channel pair using the left/right coherence measure, the at least one channel pair including a first channel only having information from the left side and a second channel only having information from the right side.

15. The decoder in accordance with claim 14, in which the receiver is operative to provide a lf/lr level information for a channel pair of an original left-front channel lf and an original left-rear channel lr, wherein a combination of the original left-front channel lf and the original left-rear channel lr forms a left master channel LM;

provide a rf/rr level information for a channel pair of an original right-front channel rf and an original right-rear channel rr, wherein a combination of the original right-front channel rf and the original right-rear channel rr forms an right master channel RM;

provide a lm/rm level information for a channel pair of the left master channel LM and the right master channel RM, wherein a combination of the left master channel LM and the right master channel RM forms a stereo master channel SM; and in which the processor is operative to provide coherence information for the left master channel LM and the right master channel RM using the left/right coherence measure;

the decoder further comprising an upmixer, the upmixer having:

a first 1-to-2 upmixer for generation of the left master channel LM and the right master channel RM from the stereo master channel SM using the lm/rm level information and the left/right coherence measure;

a second 1-to-2 upmixer for generation of the original left-front channel lf and the original left-rear channel lr from the left master channel LM using the lf/lr level information and a predefined coherence information; and a third 1-to-2 upmixer for generation of the original right-front rf channel and the original right-rear channel rr from the right master channel RM using the rf/rr level information and a predefined coherence information.

16. The decoder in accordance with claim 15, in which the receiver is operative to provide a ce/lo level information for a channel pair of an original center channel ce and of an original low-frequency channel lo, wherein a combination of the original center channel ce and of the original low-frequency channel lo forms a center master channel CM; and in which the upmixer is further comprising a fourth 1-to-2 upmixer for generation of the original center channel ce and the original low-frequency channel lo from the center master channel CM using the ce/lo level information and a predefined coherence information.

17. The decoder in accordance with claim 16, in which the receiver is operative to provide a sm/cm level information for a channel pair of the stereo master channel SM and of the center master channel CM, wherein a combination of the stereo master channel SM and of the center master channel CM forms a downmix channel; and in which the upmixer is further comprising a fifth 1-to-2 upmixer for generation of the stereo master channel SM and the center master channel CM from the downmix channel using the sm/cm level information and a predefined coherence information.

18. The decoder in accordance with claim 14, in which the receiver is operative to provide a lf/rf level information for a channel pair of an original left-front channel lf and of an original right-front channel rf, wherein a combination of the original left-front channel lf and of the original right-front channel rf forms a front master channel FM;

provide a lr/rr level information for a channel pair of an original left-rear channel lr and an original right-rear channel rr, wherein a combination of the original left-rear channel lr and the original right-rear channel rr forms a rear master channel RM; and in which the processor is operative to supply a first coherence information for the original left-front channel lf and the original right-front channel rf and to supply a second coherence information for the original left-rear channel lr and the original right-rear channel rr using the left/right coherence measure;

the decoder further comprising an upmixer, the upmixer having:

a first 1-to-2 upmixer for generation of the original left-front channel lf and the original right-front channel rf from the front master channel FM using the lf/rf level information and the left/right coherence measure;

a second 1-to-2 upmixer for generation of the original left-rear channel lr and the original right-rear channel rr from the rear master RM channel using the lr/rr level information and the left/right coherence measure.

19. The decoder in accordance with claim 18, in which the receiver is operative to provide a ce/lo level information for a channel pair of an original center channel ce and of an original low-frequency channel lo, wherein a combination of the original center channel ce and of the original low-frequency channel lo forms a center master channel CM; and in which the upmixer is further comprising a third 1-to-2 upmixer for generation of the original center channel co and the original low-frequency channel lo from the center master channel CM using the ce/lo level information and a predefined coherence information.

20. The decoder in accordance with claim 19, in which the receiver is operative to provide a fm/cm level information for a channel pair of the front master channel FM and the center master channel CM, wherein a combination of the front master channel FM and the center master channel CM forms a pure front channel PF; and in which the upmixer is further comprising a fourth 1-to-2 upmixer for generation of the front master channel FM and the center master channel CM from the pure front channel PF using the fm/cm level information and a predefined coherence information.

21. The decoder in accordance with claim 20, in which the receiver is operative to provide a pf/rm level information for a channel pair of the pure front channel PF and the rear master channel RM, wherein a combination of the pure front channel PF and the rear master channel RM forms a downmix channel; and in which the upmixer is further comprising a fifth 1-to-2 upmixer for generation of the pure front channel PF and the rear master channel RM from the downmix channel using the pf/rm level information and a predefined coherence information.

22. The decoder in accordance with claim 14, in which the processor is operative to derive coherence measures for all channel pairs by distributing the received left/right coherence as the coherence measures.

23. The decoder in accordance with claim 14, in which the receiver is operative to operate in a first mode, providing level information for channel pairs and providing a left/right coherence measure for a channel pair including a left channel and a right channel as the only coherence information of the audio signal within the parametric representation, the left/right coherence measure representing a coherence information between at least one channel pair including a first channel only having information from the left side and a second channel only having information from the right side with respect to a listening position; or to operate in a second mode, providing the level information for channel pairs and the coherence information for the same channel pairs; and in which the processor is operative to supply parametric information for channel pairs in the first mode, the processor being operative to select the level information from the parametric representation and to derive the coherence information for at least one channel pair using the left/right coherence measure, the at least one channel pair including a first channel only having information from the left side and a second channel only having information from the right side; or in the second mode, the processor being operative to select the level information from the parametric representation and to select the coherence information from the parametric representation.

24. The decoder in accordance with claim 23, in which the receiver further includes a mode receiver for selecting a operating mode using received mode information, the mode information indicating the first or the second mode to be used.

25. A method for generating a parametric representation of an audio signal having at least two original left channels and at least two original right channels with respect to a listening position, the method comprising:

generating parametric information by separately processing several pairs of channels to derive a level information for processed channel pairs and by deriving coherence information for a channel pair including a first channel only having information from the left side and a second channel only having information from the right side, and providing the parametric representation by selecting level information for travel pairs and by determining a left/right coherence measure using the coherence information and introducing the left/right coherence measure into an output datastream as the only coherence information of the audio signal within the parametric representation.

26. A method for processing a parametric representation of an original audio signal, the original audio signal having at least two original left channels on the left side and at least two original right channels on the right side with respect to a listening position, the method comprising:

providing the parametric representation of the audio signal by providing a level information for channel pairs and by providing a left/right coherence measure for a channel pair including a left channel and a right channel as the only coherence information of the audio signal within the parametric representation, the left/right coherence measure representing a coherence information between at least one channel pair including a first channel only having information from the left side and a second channel only having information from the right side; and supplying parametric information for channel pairs by selecting level information from the parametric representation and by deriving coherence information for at least one channel pair using the left/right coherence measure, the at least one channel pair including a first channel only having information from the left side and a second channel only having information from the right side.

27. A receiver or audio player having a decoder for processing a parametric representation of an original audio signal, the original audio signal having at least two original left channels on a left side and at least two original right channels on a right side with respect to a listening position, comprising:

a receiver for providing the parametric representation of the audio signal, the receiver being operative to provide level information for channel pairs and to provide a left/right coherence measure for a channel pair including a left channel and a right channel as the only coherence information of the audio signal within the parametric representation, the left/right coherence measure representing a coherence information between at least one channel pair including a first channel only having information from the left side and a second channel only having information from the right side; and a processor for supplying parametric information for channel pairs, the processor being operative to select level information from the parametric representation and to derive coherence information for at least one channel pair using the left/right coherence measure, the at least one channel pair including a first channel only having information from the left side and a second channel only having information from the right side.

28. A transmitter or audio recorder having an encoder for generating a parametric representation of an audio signal having at least two original left channels on a left side and two original right channels on a right side with respect to a listening position, comprising:

a generator for generating parametric information, the generator being operative to separately process several pairs of channels to derive a level information for processed channel pairs, and to derive coherence information for a channel pair including a first channel only having information from the left side and a second channel only having information from the right side; and a provider for providing the parametric representation by selecting the level information for channel pairs and by determining a left/right coherence measure using the coherence information and to introduce the left/right coherence measure into an output datastream as the only coherence information of the audio signal within the parametric representation.

29. A method of receiving or audio playing, the method having a method for processing a parametric representation of an original audio signal, the original audio signal having at least two original left channels on the left side and at least two original right channels on the right side with respect to a listening position, the method comprising:

providing the parametric representation of the audio signal by providing a level information for channel pairs and by providing a left/right coherence measure for a channel pair including a left channel and a right channel as the only coherence information of the audio signal within the parametric representation, the left/right coherence measure representing a coherence information between at least one channel pair including a first channel only having information from the left side and a second channel only having information from the right side; and supplying parametric information for channel pairs by selecting level information from the parametric representation and by deriving coherence information for at least one channel pair using the left/right coherence measure, the at least one channel pair including a first channel only having information from the left side and a second channel only having information from the right side.

30. A method of transmitting or audio recording, the method having a method for generating a parametric representation of an audio signal having at least two original left channels and at least two original right channels with respect to a listening position, the method comprising:

generating parametric information by separately processing several pairs of channels to derive a level information for processed channel pairs and by deriving coherence information for a channel pair including a first channel only having information from the left side and a second channel only having information from the right side; and providing the parametric representation by selecting level information for travel pairs and by determining a left/right coherence measure using the coherence information and introducing the left/right coherence measure into an output datastream as the only coherence information of the audio signal within the parametric representation.

31. A transmission system including a transmitter and a receiver, the transmitter having an encoder for generating a parametric representation of an audio signal having at least two original left channels on a left side and two original right channels on a right side with respect to a listening position, comprising:

a generator for generating parametric information, the generator being operative to separately process several pairs of channels to derive a level information for processed channel pairs, and to derive coherence information for a channel pair including a first channel only having information from the left side and a second channel only having information from the right side; and a provider for providing the parametric representation by selecting the level information for channel pairs and by determining a left/right coherence measure using the coherence information and to introduce the left/right coherence measure into an output datastream as the only coherence information of the audio signal within the parametric representation; and the receiver having a decoder for processing a parametric representation of an original audio signal, the original audio signal having at least two original left channels on a left side and at least two original right channels on a right side with respect to a listening position, comprising:

a receiver for providing the parametric representation of the audio signal, the receiver being operative to provide level information for channel pairs and to provide a left/right coherence measure for a channel pair including a left channel and a right channel as the only coherence information of the audio signal within the parametric representation, the left/right coherence measure representing a coherence information between at least one channel pair including a first channel only having information from the left side and a second channel only having information from the right side; and a processor for supplying parametric information for channel pairs, the processor being operative to select level information from the parametric representation and to derive coherence information for at least one channel pair using the left/right coherence measure, the at least one channel pair including a first channel only having information from the left side and a second channel only having information from the right side.

32. A method of transmitting and receiving, the method of transmitting having a method for generating a parametric representation of an audio signal having at least two original left channels and at least two original right channels with respect to a listening position, the method comprising:

generating parametric information by separately processing several pairs of channels to derive a level information for processed channel pairs and by deriving coherence information for a channel pair including a first channel only having information from the left side and a second channel only having information from the right side, and providing the parametric representation by selecting level information for travel pairs and by determining a left/right coherence measure using the coherence information and introducing the left/right coherence measure into an output datastream as the only coherence information of the audio signal within the parametric representation;

and the method of receiving having a method for processing a parametric representation of an original audio signal, the original audio signal having at least two original left channels on the left side and at least two original right channels on the right side with respect to a listening position, the method comprising:

providing the parametric representation of the audio signal by providing a level information for channel pairs and by providing a left/right coherence measure for a channel pair including a left channel and a right channel as the only coherence information of the audio signal within the parametric representation, the left/right coherence measure representing a coherence information between at least one channel pair including a first channel only having information from the left side and a second channel only having information from the right side; and supplying parametric information for channel pairs by selecting level information from the parametric representation and by deriving coherence information for at least one channel pair using the left/right coherence measure, the at least one channel pair including a first channel only having information from the left side and a second channel only having information from the right side.

33. A non-transitory storage medium storing a program code for, when running a computer, performing the method of claim 25.

* * * * *